US005638775A

United States Patent [19]

Hollis

[11] Patent Number: 5,638,775

[45] Date of Patent: Jun. 17, 1997

[54] SYSTEM FOR ACTUATING FLOW CONTROL VALVES IN A TEMPERATURE CONTROL SYSTEM

[76] Inventor: Thomas J. Hollis, 5 Roxbury Dr., Medford, N.J. 08055

[21] Appl. No.: 576,608

[22] Filed: Dec. 21, 1995

[51] Int. Cl.[6] ..... F01D 7/16

[52] U.S. Cl. ..... 123/41.55; 137/340; 251/29; 123/41.08

[58] Field of Search ..... 123/41.08, 41.55; 137/340; 251/29, 30.01

[56] References Cited

U.S. PATENT DOCUMENTS

| | | | |
|---|---|---|---|
| 2,799,466 | 7/1957 | Hickerson . | |
| 4,061,155 | 12/1977 | Sopha | 137/85 |
| 4,506,701 | 3/1985 | Masaki et al. | 137/596.17 |
| 4,759,316 | 7/1988 | Itakura | 123/41.08 |
| 4,982,902 | 1/1991 | Knapp et al. | 239/585 |
| 4,989,150 | 1/1991 | Tazawa | 364/431.03 |
| 5,170,755 | 12/1992 | Kano et al. | 123/90.17 |
| 5,217,199 | 6/1993 | Frey | 251/29 |
| 5,271,599 | 12/1993 | Kolchinsky et al. | 251/30.04 |
| 5,415,147 | 5/1995 | Nagle et al. | 123/563 |
| 5,458,096 | 10/1995 | Hollis | 251/30.01 |

FOREIGN PATENT DOCUMENTS

| | | |
|---|---|---|
| 3435833 | 4/1986 | Germany . |
| 3516502 | 11/1986 | Germany . |
| 4033261 | 4/1992 | Germany . |

*Primary Examiner*—David A. Okonsky
*Attorney, Agent, or Firm*—Seidel, Gonda, Lavorgna & Monaco

[57] ABSTRACT

A pressurization system for controlling actuation of flow control valves in a temperature control system is disclosed. The pressurization system includes a housing which has a chamber formed in it. An input injector is in communication with the housing and is adapted to channel a flow of pressurized fluid into the chamber. An output injector is also in communication with the housing and is adapted to channel a flow of pressurized fluid out of the chamber. Fluid flow control means is connected to the housing and has at least one fluid outlet. The fluid outlet is adapted to direct a flow of pressurized fluid to a flow control valve to control actuation of the valve. The fluid flow control means has an open position for allowing a flow of pressurized fluid out of the fluid outlet and a closed position for preventing fluid flow out of the fluid outlet. The fluid flow control means receives signals from an engine computer for controlling actuation of the fluid flow control means between its open and closed positions. First and second solenoids are preferably connected to the injectors and receive signals from the engine computer for controlling actuation of the injectors between their open and closed positions. In one embodiment, the fluid control means includes a solenoid with three outlets formed in it. Each outlet directs a flow of pressurized fluid to a prescribed flow control valve.

25 Claims, 11 Drawing Sheets

SYSTEM FOR ACTUATING FLOW CONTROL VALVES IN A TEMPERATURE CONTROL SYSTEM

CROSS-REFERENCE TO RELATED APPLICATION

This application is related to U.S. application Ser. No. 08/390,711, filed Feb. 17, 1995, now abandoned and entitled "SYSTEM FOR MAINTAINING ENGINE OIL AT AN OPTIMUM TEMPERATURE," which is a continuation-in-part of U.S. Pat. No. 5,463,745 entitled "SYSTEM FOR DETERMINING THE APPROPRIATE STATE OF A FLOW CONTROL VALVE AND CONTROLLING ITS STATE". The entire disclosures of both the application and patent are incorporated herein by reference. This application is also related to co-pending U.S. application entitled "SYSTEM FOR CONTROLLING THE HEATING OF TEMPERATURE CONTROL FLUID USING THE ENGINE EXHAUST MANIFOLD" (Attorney Docket No. 8668-26) filed concurrently with this application.

FIELD OF THE INVENTION

This invention relates to a system for controlling flow of temperature control fluid in a temperature control system and, more particularly, to an injection system for actuating flow control valves for controlling temperature control fluid flow.

BACKGROUND OF THE INVENTION

Page 169 of the *Goodheart-Willcox automotive encyclopedia*, The Goodheart-Willcox Company, Inc., South Holland, Ill., 1995 describes that as fuel is burned in an internal combustion engine, about one-third of the heat energy in the fuel is converted to power. Another third goes out the exhaust pipe unused, and the remaining third must be handled by a cooling system. This third is often underestimated and even less understood.

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is started, the coolant rarely becomes hot enough to boil. Thus, the coolant does not need to flow through the radiator. Nor is it desirable to dissipate the heat energy in the coolant in such environments since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, coolant systems employ a thermostat. The thermostat operates as a one-way valve, blocking or allowing flow to the radiator. Most prior art coolant systems employ wax pellet type or bimetallic coil type thermostats. These thermostats are self-contained devices which open and close according to precalibrated temperature values.

Coolant systems must perform a plurality of functions, in addition to cooling the engine parts. In cold weather, the cooling system must deliver hot coolant to heat exchangers associated with the heating and defrosting system so that the heater and defroster can deliver warm air to the passenger compartment and windows. The coolant system must also deliver hot coolant to the intake manifold to heat incoming air destined for combustion, especially in cold ambient air temperature environments, or when a cold engine is started. Ideally, the coolant system should also reduce its volume and speed of flow when the engine parts are cold so as to allow the engine to reach an optimum hot operating temperature. Since one or both of the intake manifold and heater need hot coolant in cold ambient air temperatures and/or during engine start-up, it is not practical to completely shut off the coolant flow through the engine block.

Practical design constraints limit the ability of the coolant system to adapt to a wide range of operating environments. For example, the heat removing capacity is limited by the size of the radiator and the volume and speed of coolant flow. The state of the self-contained prior art wax pellet type or bimetallic coil type thermostats is typically controlled only by coolant temperature.

Numerous proposals have been set forth in the prior art to more carefully tailor the coolant system to the needs of the vehicle and to improve upon the relatively inflexible prior art thermostats.

The goal of all engine cooling systems is to maintain the internal engine temperature as close as possible to a predetermined optimum value. Since engine coolant temperature generally tracks internal engine temperature, the prior art approach to controlling internal engine temperature control is to control engine coolant temperature. Many problems arise from this approach. For example, sudden load increases on an engine may cause the internal engine temperature to significantly exceed the optimum value before the coolant temperature reflects this fact. If the thermostat is in the closed state just before the sudden load increase, the extra delay in opening will prolong the period of time in which the engine is unnecessarily overheated.

Another problem occurs during engine start-up or warm-up. During this period of time, the coolant temperature rises more rapidly than the internal engine temperature. Since the thermostat is actuated by coolant temperature, it often opens before the internal engine temperature has reached its optimum value, thereby causing coolant in the water jacket to prematurely cool the engine. Still other scenarios exist where the engine coolant temperature cannot be sufficiently regulated to cause the desired internal engine temperature.

When the internal engine temperature is not maintained at an optimum value, the engine oil will also not be at the optimum temperature. Engine oil life is largely dependent upon wear conditions. Engine oil life is significantly shortened if an engine is run either too cold or too hot. As noted above, a cold running engine will have less complete combustion in the engine combustion chamber and will build up sludge more rapidly than a hot running engine. The sludge contaminates the oil. A hot running engine will prematurely break down the oil. Thus, more frequent oil changes are needed when the internal engine temperature is not consistently maintained at its optimum value.

Prior art cooling systems also do not account for the fact that the optimum oil temperature varies with ambient air temperature. As the ambient air temperature declines, the internal engine components lose heat more rapidly to the environment and there is an increased cooling effect on the internal engine components from induction air. To counter these effects and thus maintain the internal engine components at the optimum operating temperature, the engine oil should be hotter in cold ambient air temperatures than in hot ambient air temperatures. Current prior art cooling systems cannot account for this difference because the cooling system is responsive only to coolant temperature.

Prior art cooling systems have also not taken full advantage of the heat generated during combustion of the air/fuel mixture. As discussed above, approximately one third of heat generated during the combustion of the fuel/air mixture is transferred through the exhaust system. Several prior art systems have attempted to utilize this heat for improving the efficiency of an engine. For example, U.S. Pat. No. 4,079,715 discloses a prior art method for using exhaust gases to heat the intake air. Special exhaust passageways are attached to the exhaust manifold and direct the exhaust gases through or adjacent to the intake manifold thereby permitting convection of the exhaust gas heat to the intake air.

A second prior art method for utilizing the heat in the exhaust gases is disclosed on pages 229 of the *Goodheart-Willcox automotive encyclopedia*, The Goodheart-Willcox Company, Inc., South Holland, Ill., 1995. This method requires the incorporation of a special duct or "crossover passage" around the exhaust manifold that traps the heat which is otherwise dissipated. This trapped heated air is then routed to the intake manifold where it preheats the intake air.

These prior art methods all require the addition of special, relatively heavy ducting which must be designed to be thermally compatible with the temperatures in the exhaust gases. Additionally, these systems have all been limited to heating the intake air. Hence, the prior art methods have not utilized the heat in the exhaust gases to assist in preheating the engine and/or the engine oil.

While many of the prior art systems address the problem of cooling an internal combustion engine, none have provided a workable, cost efficient system. Accordingly, a need therefore exists for a system which optimally controls the flow of a fluid in a cooling system and which requires minimal modifications to the current engine arrangement.

SUMMARY OF THE INVENTION

A pressurization system for controlling actuation of flow control valves in a temperature control system is disclosed. The pressurization system includes a housing which has a chamber formed in it. An input injector is in communication with the housing and is adapted to channel a flow of pressurized fluid into the chamber. An output injector is also in communication with the housing and is adapted to channel a flow of pressurized fluid out of the chamber. Fluid flow control means is connected to the housing and has at least one fluid outlet. The fluid outlet is adapted to direct a flow of pressurized fluid to a flow control valve to control actuation of the valve. The fluid flow control means has an open position for allowing a flow of pressurized fluid out of the fluid outlet and a closed position for preventing fluid flow out of the fluid outlet. The fluid flow control means receives signals from an engine computer for controlling actuation of the fluid flow control means between its open and closed positions.

First and second solenoids are preferably connected to the injectors and receive signals from the engine computer for controlling actuation of the injectors between their open and closed positions.

In one embodiment, the fluid control means includes a solenoid with at least one and preferably three fluid outlets formed in it. Each outlet directs a flow of pressurized fluid to a prescribed flow control valve. The solenoid controls flow along each outlet based on signals received from the engine computer.

An inlet line supplies a flow of fluid to the housing. The fluid is preferably hydraulic fluid. An outlet line channels a flow of fluid from the housing to a fluid reservoir.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

While the invention will be described in connection with one or more preferred embodiments, it will be understood that it is not intended to limit the invention to any particular embodiment. On the contrary, it is intended to cover all alternatives, modifications and equivalents as may be included within the spirit and scope of the invention as defined by the appended claims.

Certain terminology is used herein for convenience only and is not be taken as a limitation on the invention. Particularly, words such as "upper," "lower," "left," "right," "horizontal," "vertical," "upward," and "downward" merely describe the configuration shown in the figures. The terms "inhibiting" and "restricting" are intended to cover both partial and full prevention of fluid flow.

For the sake of brevity, when discussing the flow of temperature control fluid in the engine, it should be understood that the fluid flows through water jackets formed within the engine. For example, when discussing the flow of temperature control fluid through an engine block, it should be understood that the fluid is flowing through a water jacket of the engine block.

Figure 1:
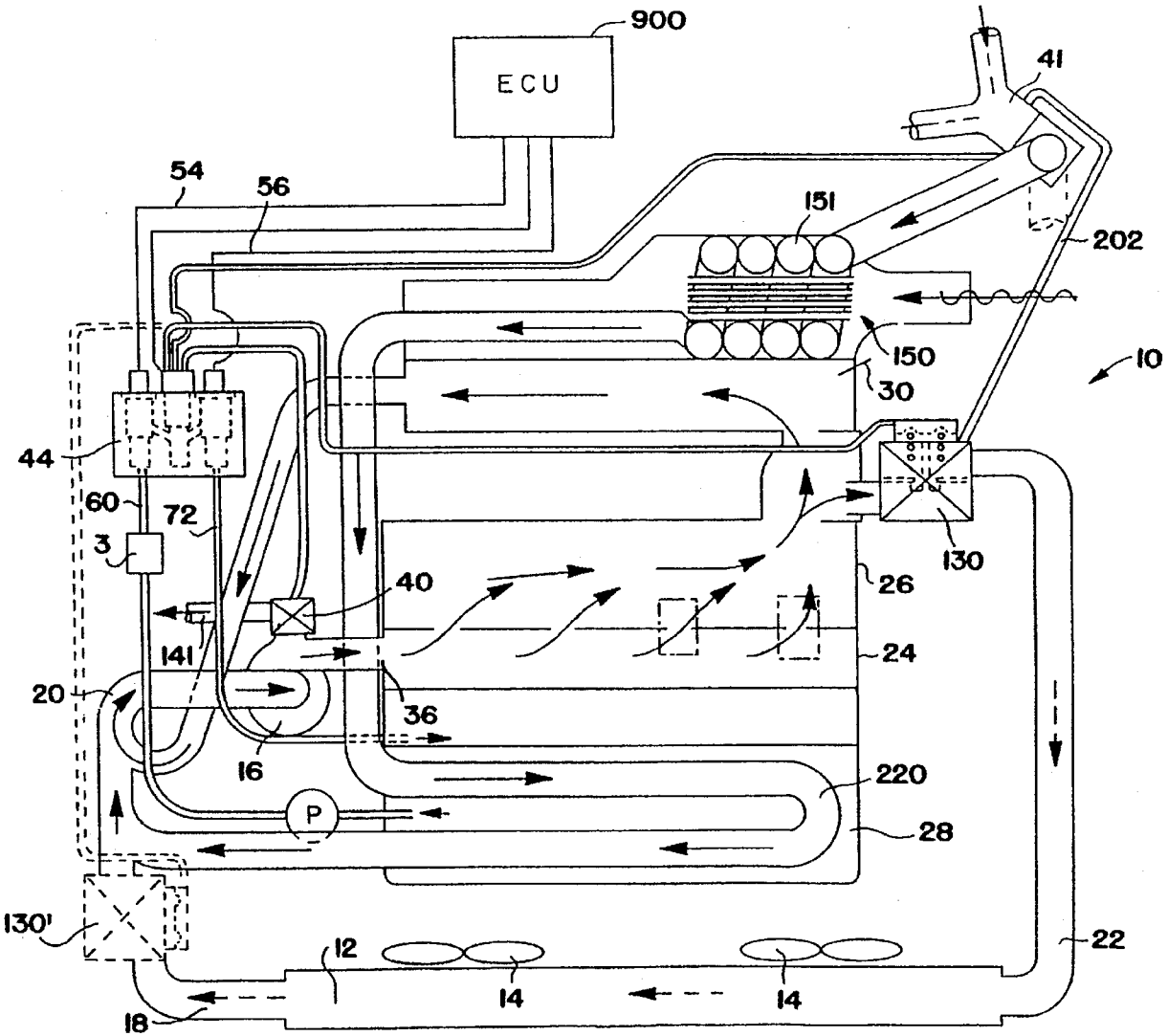
FIG. 1 is schematic side view of an internal combustion engine incorporating the present invention and showing the various temperature control fluid flow paths through the engine.

FIG. 1 illustrates an internal combustion engine generally designated with numeral 10. The internal combustion engine 10 includes a radiator 12 mounted in the forward facing portion of an engine compartment (not shown). Conventionally mounted to the aft of the radiator 12, between the radiator 12 and the engine 10, are one or more air circulation fans 14 adapted for drawing cool air through the radiator 12. A radiator outlet tube 18 is attached to the lower portion of radiator 12 and extends to and attaches with an inlet port 20 on a water pump 16. A radiator inlet tube 22 extends from the engine 10 and attaches to the upper portion of the radiator 12. The radiator inlet and outlet tubes 18, 22 direct temperature control fluid in to and out of the radiator 12.

The internal combustion engine illustrated includes an engine block 24 and one or more cylinder heads 26 mounted to the upper portions of the engine block 24. Attached to the lower portion of the engine block 24 is an oil pan 28 which provides a reservoir for hydraulic engine lubricating oil. An oil pump (not shown) is located within the oil pan 28 or attached to the engine block 24 and operates to direct hydraulic lubricating oil to the various members being driven within the engine. An intake manifold 30 is shown mounted to the cylinder heads 26 on the upper portion of the engine 10. The intake manifold 30 directs a flow of air into the combustion chamber of the engine for mixing with the fuel.

The water pump 16 is attached to the engine block 24. The water pump 16 has two primary modes of operation in the present invention. In the first mode of operation, the water pump functions in a similar manner as a conventional water pump. A pulley drives an internally mounted impeller which, in turn, directs the flow of temperature control fluid entering into the water pump 16 from its inlet port 20. The rotary motion of the impellers produces centrifugal forces on the temperature control fluid which cause the fluid to flow toward one or more block inlet ports 36 formed in the engine block 24. The block inlet ports 36 are in communication with the engine block 24.

Upon entering the engine block 24 in the first mode of operation, the temperature control fluid flows through the engine block 24 and then enters into the cylinder heads 26. The effect of this temperature control fluid flow is the cooling of the engine block and cylinder heads through the removal of the heat generated during engine operation.

Figure 3:
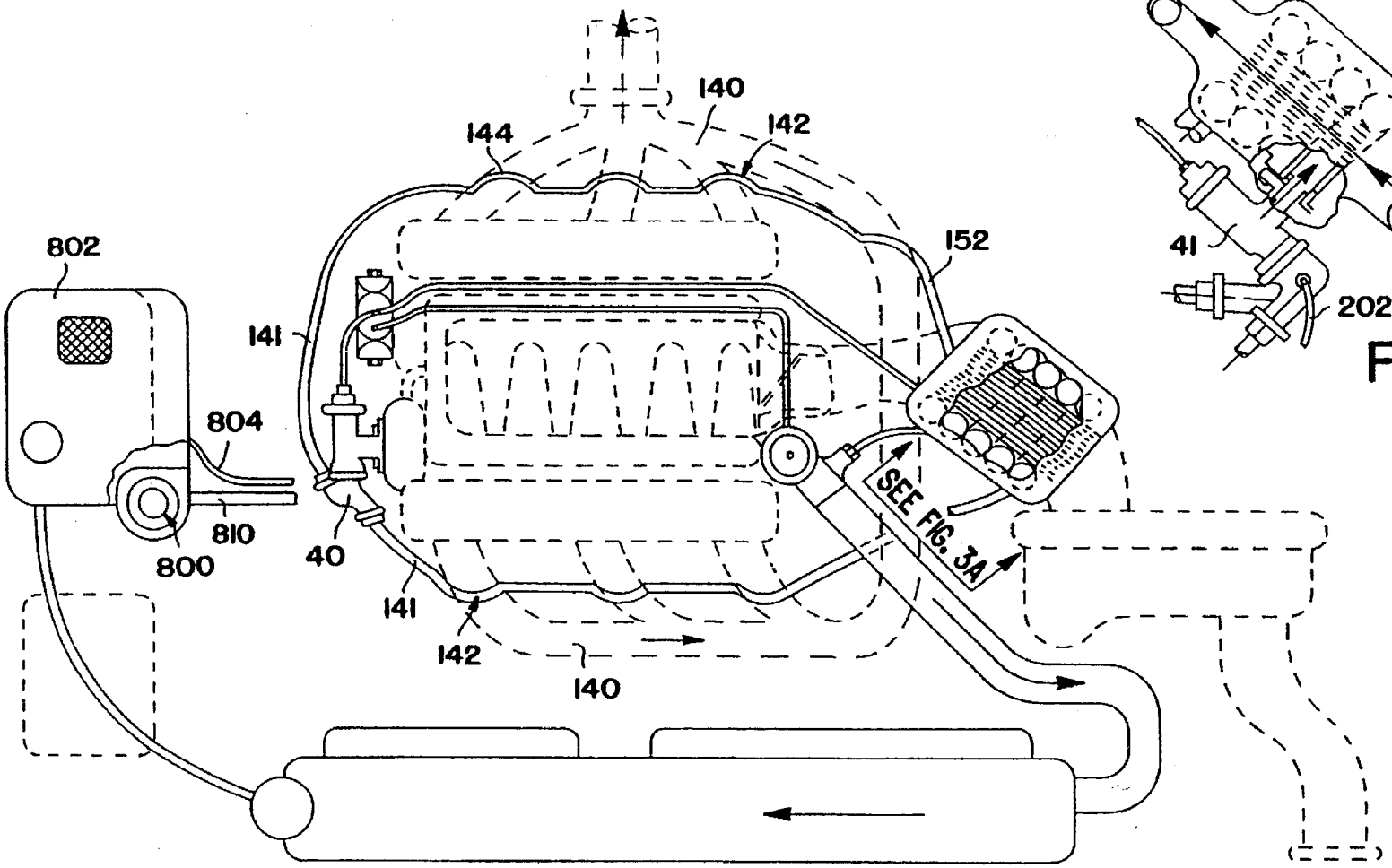
FIG. 3 is a diagrammatical plan view of an engine incorporating an exhaust heat assembly according to the present invention.
Figure 4:
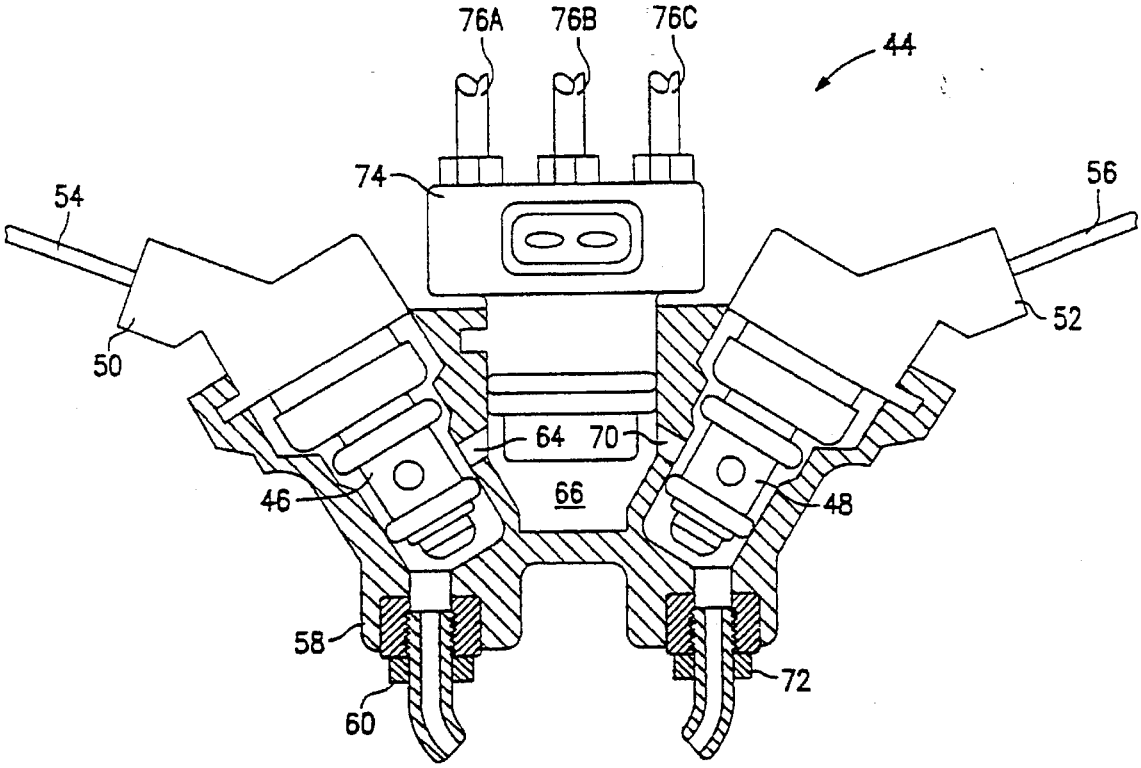
FIG. 4 is a sectional view of a hydraulic solenoid injector assembly according to the present invention useful for controlling actuation of control valves.

In the second mode of the water pump operation, the temperature control fluid circulating in the water pump 16 is not entirely directed into the engine block 24 but, instead, at least a portion of the temperature control fluid is channeled to an exhaust heat assembly 142 (shown in FIG. 3) which is positioned adjacent to an exhaust manifold 140. The heat from the exhaust manifold 140 is utilized to heat the temperature control fluid. The channeling of the temperature control fluid between the engine block 24 and the exhaust heat assembly 142 is controlled by one or more control valves 40. FIG. 4 of co-pending U.S. application Ser. No. 08/447,468 discloses in detail one type of control valve useful for controlling the fluid flow.

Figure 2B:
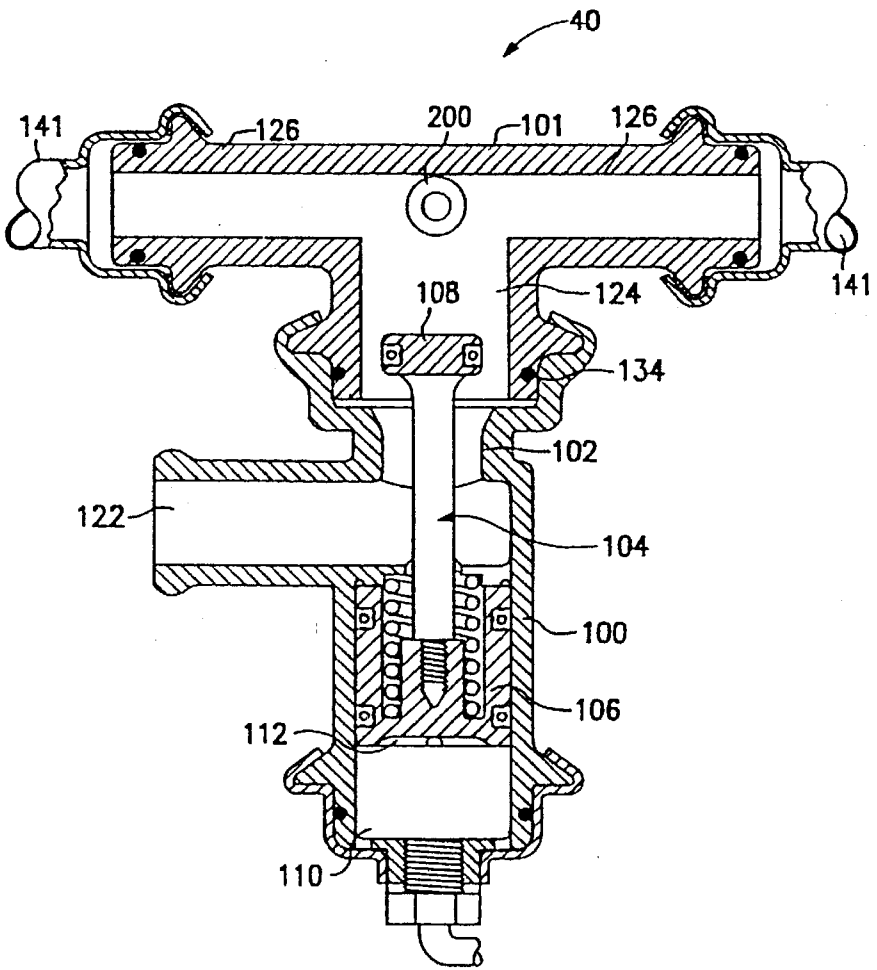
FIGS. 2A and 2B are sectional views of one embodiment of a control valve for controlling flow of temperature control fluid through an engine.
Figure 2A:
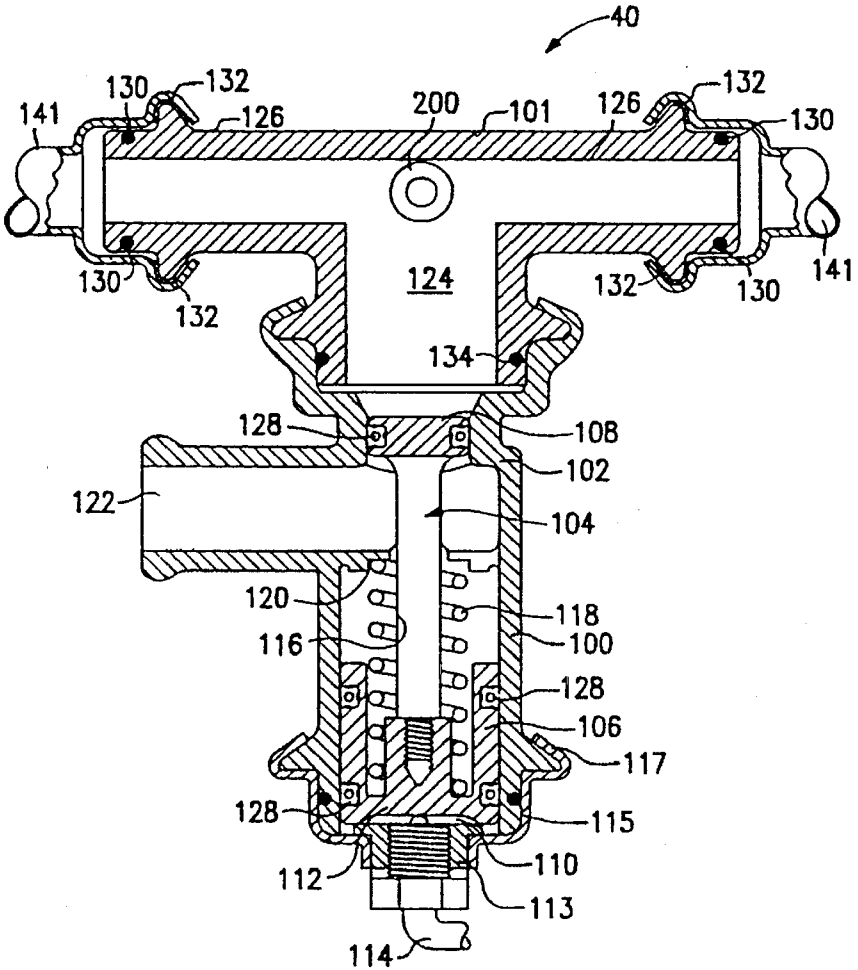

An alternate and more preferred control valve 40 is shown in FIGS. 2A and 2B and includes first and second housing portions 100, 101. The first housing portion 100 is crimped into engagement with the second housing portion 101. Alternate attachment mechanisms, such as threads, are well within the scope of the invention. The control valve 40 is actuatable between a first "normal flow" position or state and a second "exhaust heating flow" position or state. In the first position, shown in FIG. 2A, an actuatable piston 104 prevents the temperature control fluid from flowing through a passageway 102 in the first housing portion 100 leading to the exhaust heat assembly 142. The piston 104 includes a pressure head 106 and a sealing head 108. The pressure head 104 is slidably disposed within a chamber 110 within the first housing portion 100 and has a pressure receiving surface 112 formed thereon. A fluid line 114 is connected to the first housing portion 100 and is in fluid communication with the chamber 110. The fluid line 114 is operative for directing a pressurized medium into the chamber 110 for increasing the pressure therein. As will be discussed in more detail below, this increase in pressure is designed to displace the pressure head 106 and the piston 104. In a preferred embodiment, the fluid line is threaded into an insert 113. The insert 113, in turn, is mounted to the first housing portion 100 by means of a cap 115. Attachment of the cap 115 to the first housing portion 100 is provided by a crimp joint 117 as shown. Alternately, the cap 115 may be threaded into engagement with the first housing portion 100. Flow of the medium is channeled out of the fluid line 114, through the insert 113 and into the chamber 110.

The sealing head 108 is slidably disposed within the passageway 102 in the first housing portion 100. The sealing head 108 is designed to prevent temperature control fluid from passing through the passageway 102 when the valve 40 is in its first position. A shaft 116 extends between and attaches to the sealing head 108 and the piston head 106. In the embodiment illustrated, the shaft 116 is formed integral with the sealing head 108 and is threaded into engagement with the piston head 106. A variety of alternate attachment means can be substituted for the illustrated embodiment.

As is apparent from FIGS. 2A and 2B, pressurization of the chamber 110 produces displacement of the pressure head 106. This results in concurrent displacement of the sealing head 108. A biasing spring 118 is located within the first housing portion 100 between the pressure head 106 and a seat 120. The biasing spring 118 urges the pressure head 106 away from the passageway 102 and opposes any displacement of piston 104 caused by pressure in the chamber 110.

A valve inlet 122 channels temperature control fluid to the passageway 102. The passageway 102 communicates with a valve conduit 124 formed in the second housing portion 101. The valve conduit 124, in turn, communicates with one or more valve outlets 126 which permit fluid flow out of the valve 40. Exhaust input tubes 141 are attached to the valve outlets 126 and communicate with the exhaust heat assembly 142. Attachment between the exhaust heat inlet tubes 141 and the valve outlets 126 is provided by crimps.

When the valve 40 is in its first position (shown in FIG. 2A), the sealing head 108 prevents the temperature control fluid from flowing through the passageway 102 to the valve conduit 124 and valve outlets 126.

The second position of the valve 40 is shown in FIG. 2B. In this position, at least a portion of the temperature control fluid is allowed to flow through the passageway 102, along the valve conduit 124, and out of the valve 40 through the valve outlets 126. From the valve 40, the temperature control fluid is permitted to flow to the exhaust heat assembly 142. In this second position of the control valve 40, a sufficient amount of fluid medium has been supplied to the chamber 110 to overcome the spring force associated with the biasing spring 118 and to force the piston 104 to slide within the first housing portion 100. This causes compression of the spring 118 and moves the sealing head 108 out of the passageway 102, thus permitting fluid to flow therethrough.

Seals 128 may be placed between the walls of the first housing portion 100 and the pressure head 106 and sealing head 108 to prevent leakage of the pressurizing medium into the valve inlet 122. The seals 128 are preferably POLY-PAK® retention seals manufactured by Parker-Hannifin Corp., Cleveland, Ohio, VITON® elastomer seals manufactured by E.I. Du Pont De Nemours & Co., Wilmington, Del., or teflon O-rings.

Due to the high temperatures associated with the exhaust heat assembly 142, high temperature seals 130 are preferably utilized at the attachment of the exhaust manifold inlet tubes 141 to the valve outlets 126. The high temperature seals are preferably radial O-rings. To provide further sealing, a secondary seal 132 may also be incorporated. This secondary seal 132 is preferably a soft copper flange seal. The high temperatures of the exhaust heat assembly 142 also require the addition of a high temperature radial O-ring seal between the first and second housing portions 100, 101.

As discussed above, the valve 40 has first and second housing portions 100, 101. One reason for utilizing two housing portions is the need to prevent or minimize heat transfer from the exhaust heat assembly 142. Related application Ser. No. 08/447,468 discusses in detail the temperature related problems associated with the exhaust heating assembly 142. To prevent conduction of the heat to the water pump 16, it is desirable to manufacture the valve 40 from a high temperature non-conductive material, such as ceramic. However, due to the high cost associated with the manufacture of ceramic components, it is preferable that only a portion of the valve 40 (e.g., the second housing portion 101) be made from ceramic material. The remainder of the valve 40 (e.g., the first housing portion 100, the cap 115) may be made from a less costly material, such as aluminum or plastic, thereby designating the valve as a bi-material valve. An O-ring seal 134 is preferably utilized at the attachment of the second housing portion 101 to the first housing portion 100 and between the cap 115 and the first housing portion 100.

It should be appreciated that modifications could be made to the control valve 40 without departing from the scope of this invention. For example, the piston 104 could be replaced by a diaphragm valve arrangement which provides translation of the sealing head 108. Furthermore, it is also possible to eliminate the biasing spring 118 and, instead, utilize the elastomeric properties of the diaphragm to provide the biasing needed. Alternately, a rotary valve may be utilized to control flow to the exhaust heat assembly 142. Those skilled in the art, after having read the instant specification, would readily be capable of modifying the above valve configuration without detracting from the operability of the invention.

Figure 3A:
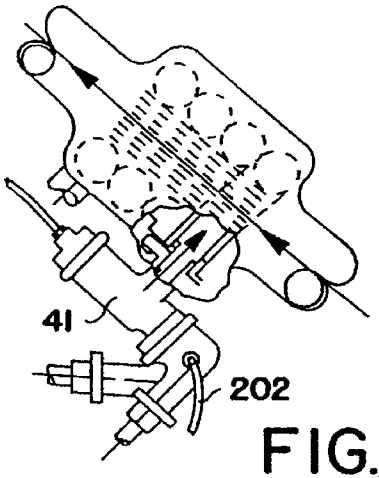
FIG. 3A is a sectional view of an air induction system used with the present invention taken along line 3A in FIG. 3.

The control valve 40 is located between the water pump 16 and the exhaust heat assembly 142. Preferably the control valve 40 is attached directly to an outlet on the water pump 16 and controls the flow of temperature control fluid to a heating conduit 144 in the exhaust heat assembly 142. Referring to FIGS. 3 and 3A, the exhaust heat assembly 142 is illustrated with a second control valve 41 mounted downstream of the heating conduit 144. The second valve 41 is similar in configuration and operates is a similar manner as the first control valve 40. The second control valve 41 has a first position wherein flow of temperature control fluid through the valve 41 is inhibited and a second position wherein the flow of the temperature control fluid is allowed.

The second control valve 41 controls the flow of the temperature control fluid from the heating conduit 144 of the exhaust heat assembly 142 and to various components in or on the engine. For example, in one embodiment, the second control valve 41 controls flow of the temperature control fluid to an air induction system (designated by numeral 150 in FIG. 1) for heating air entering a throttle prior to mixture with fuel. Co-pending application Ser. No. 08/533,471 (Attorney Docket No. 8668-14), entitled "SYSTEM FOR PREHEATING INTAKE AIR FOR AN INTERNAL COMBUSTION ENGINE", filed Sep. 25, 1995 discusses in detail some preferred embodiments for an air induction heating system. The entire disclosure of that application is incorporated herein by reference. In this embodiment, the temperature control fluid flows through a heat exchanger 151 mounted to the engine within the flow of intake air, preferably between the air cleaner and the throttle body.

When the second control valve 41 is in its second position, temperature control fluid is allowed to flow through the heat exchanger 151. Heat energy is transferred from the temperature control fluid to the passing flow of air. This results in the heating of the intake air. When the temperature control fluid discharges from the heat exchanger 151, it preferably flows through the conductive tubes 220 located in the oil pan 28 (FIG. 1). From the oil pan 28, the temperature control fluid is channeled back to the water pump 16 for recirculation through the engine. In an alternate embodiment (not shown), the temperature control fluid is channeled from the second control valve 41 directly to the conductive tubes 220 in the oil pan 28.

As discussed above, the control valves 40, 41 are actuatable between first and second positions. The actuation is achieved by means of a pressurization system, such as a hydraulic solenoid injector system (generally designated 44 in FIG. 1). The hydraulic injector system 44 controls the flow of a fluid medium, such as hydraulic fluid, to and from the control valves 40, 41 for actuating the valves between their first and second positions. A preferred embodiment of the hydraulic solenoid injector system 44 is shown in more detail in FIGS. 1 and 4 and includes input and output hydraulic fluid injectors 46, 48. Attached to the hydraulic fluid injectors 46, 48 are first and second solenoids 50, 52. The solenoids are designed to receive signals on control lines 54, 56 from an engine computer unit (ECU) 900 for controlling the opening and closing of their respective hydraulic injectors 46, 48.

A source of pressurized fluid is connected to a housing 58 of the hydraulic solenoid injector system 44 through fluid inlet connector 60. In the preferred embodiment, the source of pressurized fluid is engine lubrication oil flowing either directly from the oil pump or, more preferably, from an oil filter (designated by the numeral 3 in FIG. 1). The oil filter 3 prevents debris from entering into the hydraulic injectors causing damage and/or malfunction. The filter is preferably replaceable. When the input hydraulic injector 46 is open, a flow of pressurized hydraulic fluid enters into the fluid inlet connector 60, passes through the input hydraulic injector 46 and into passageway 64. This results in the filling and pressurizing of chamber 66 provided that the output hydraulic injector 48 is closed. From the chamber 66, the hydraulic fluid is provided to the control valves 40, 41 via supply lines.

The output hydraulic injector 48 controls the emptying or depressurization of the chamber 66. The opening of the output hydraulic injector 48 causes the hydraulic fluid in chamber 66 to drain along passage 70 and through fluid outlet connector 72. A hydraulic fluid line from the fluid outlet connector 72 leads to a hydraulic fluid reservoir, such as the engine oil pan 28.

In the preferred embodiment, the hydraulic injectors are Siemens Deka II modified hydraulic fluid injectors. Details of these injectors are provided in the above-referenced related patent applications. Other solenoid-type injectors can be readily substituted therefor without departing from the scope of the invention.

The hydraulic solenoid injector system 44 also preferably includes a third solenoid 74 mounted to the housing 58 and in communication with the chamber 66. The third solenoid 74 is preferably a multi-way solenoid which provides a means for controlling fluid flow over one or more supply lines 76 leading to the control valves 40, 41 and an electronic engine temperature control valve (EETC) 130. In the illustrated embodiment, the third solenoid controls flow of a fluid medium along three supply lines (designated by numerals $76_A$, $76_B$ and $76_C$). Each supply line channels a flow of fluid for pressurizing a valve. While three supply lines are shown in the preferred embodiment, alternate configurations are possible and well within the purview of the claims. Supply line $76_A$ supplies pressurized fluid to the control valve 40 which controls flow of the temperature control fluid leading to the exhaust heat assembly 142 from the water pump 16. Supply line $76_B$ supplies pressurized fluid to the control valve 41 located downstream from the exhaust heat assembly 142 which controls flow of temperature control fluid from the exhaust heat assembly to the engine. Supply line $76_C$ supplies pressurized fluid to the EETC valve 130 which controls flow of temperature control fluid between the engine and the radiator. The specific construction of the solenoid should be readily apparent to those skilled in the art based on the foregoing discussion and the following details on its operation.

During use the hydraulic solenoid injector system 44 is filled and drained of pressurized fluid such as hydraulic oil. To assist in the drainage, the injectors 46, 48 are mounted on opposite sides of a central plane and are angled with respect to that plane with the fill and drain openings located at the lowest point in the housing 58. Passages 64 and 70 are similarly angled downward from the chamber 66. Consequently, when it is desired to drain the hydraulic solenoid injector system, the natural force of gravity assists in draining the passages 64, 70 and injectors 46, 48.

As discussed above, the hydraulic solenoid injector system 44 provides pressurized fluid for actuating both control valves 40, 41 and the EETC valve 130. The EETC valve 130 is shown in FIG. 1 controlling the flow of the temperature control fluid to the radiator 12. An alternate position for the EETC valve is shown in phantom and designated with the numeral 130'. U.S. Pat. No. 5,458,096 provides a detailed discussion of various embodiments of the EETC valve 130 and their operation and is incorporated herein by reference.

Figure 5:
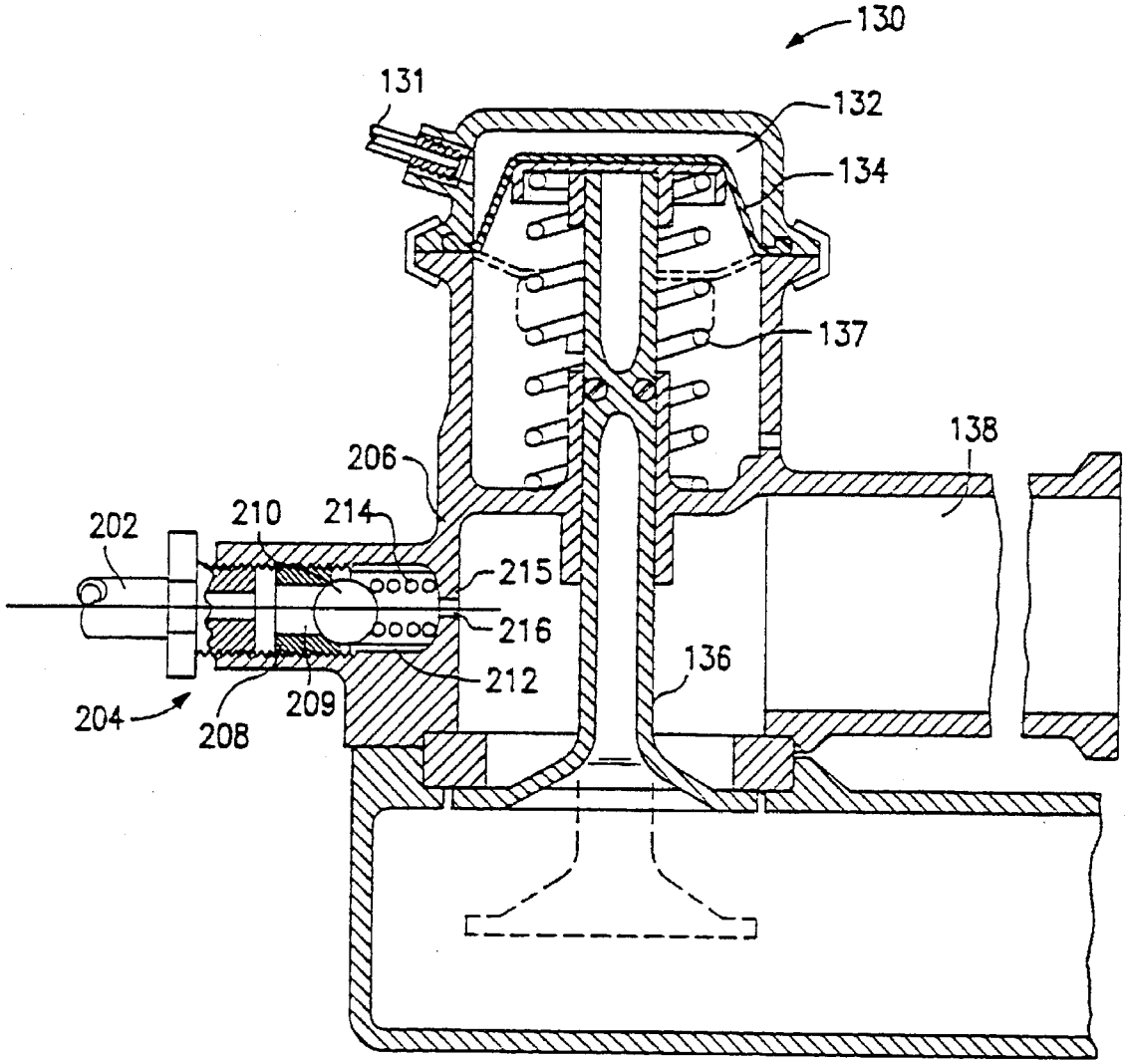
FIG. 5 is a sectional view of an electronic engine temperature control valve according to the present invention.

One preferred embodiment of the EETC valve 130 is shown in FIG. 5. In this embodiment, a fluid line 131 from the hydraulic solenoid injection system 44 supplies a flow of pressurized fluid into a chamber 132 within the valve 130. The filling of the chamber 132 with the pressurized fluid causes a flexible diaphragm 134 to displace a valve member 136 compressing a spring 137. Displacement of the valve member 136 permits temperature control fluid to flow along the channel 138 leading to the radiator 12. The draining of the chamber 132, in combination with the energy stored in the compressed spring 137, causes the valve member 136 to reciprocate back into its first position shown in the figure.

Figure 6:
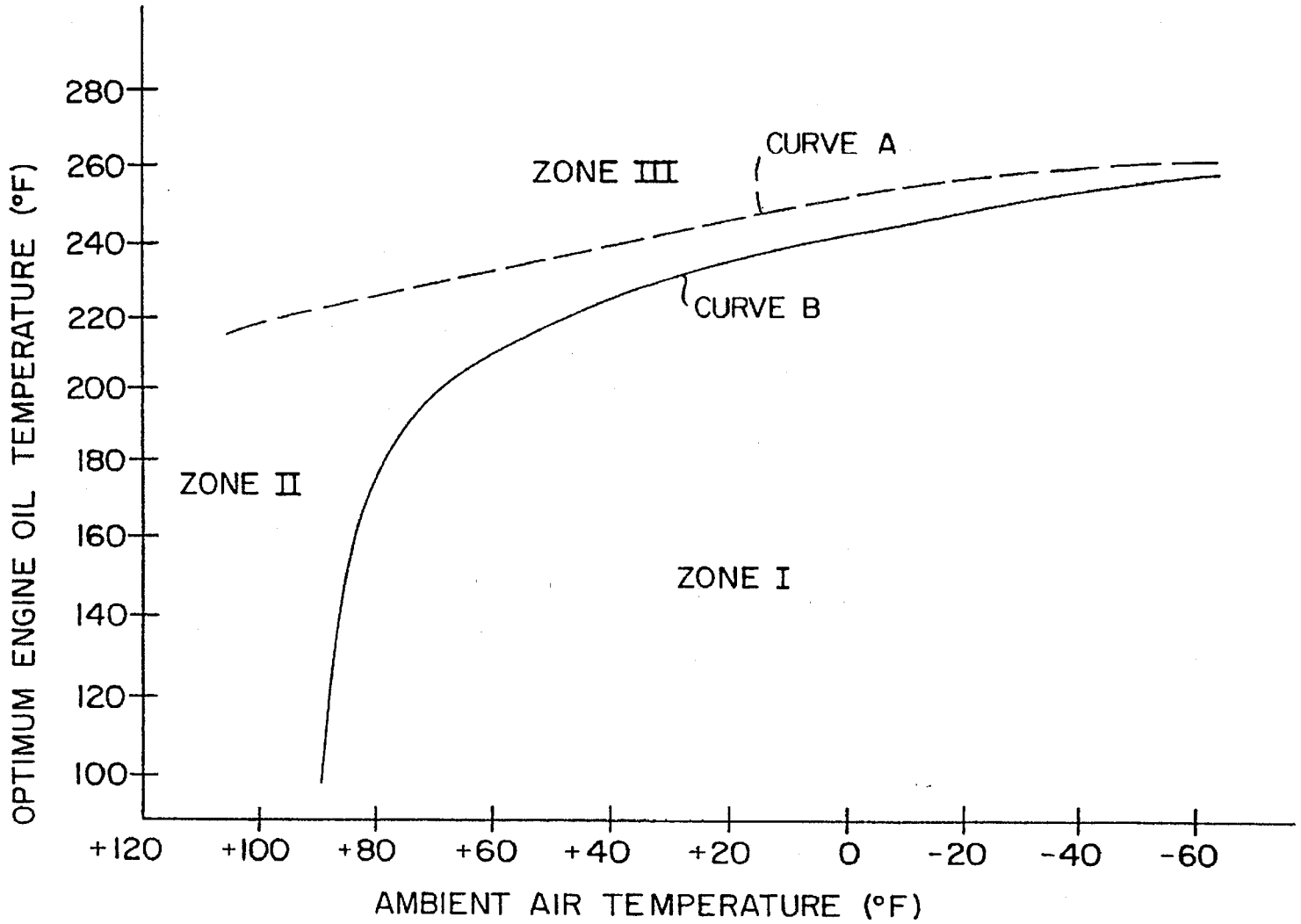
FIG. 6 illustrates two temperature control curves according to the present invention.

Exemplary control curves are shown in FIG. 6 for use by the ECU 900 in controlling the actuation of the valves. The two curves shown are functions of an engine operating parameter and ambient condition. Preferably the curves are a function of engine oil temperature and ambient air temperature. Related application Ser. No. 08/390,711, discusses how the internal engine components lose heat more rapidly to the environment as the ambient air temperature decreases. By controlling the temperature of the temperature control fluid or coolant according to a predetermined temperature control curve, it is possible to effectively control the temperature of the engine. However, in order to account of environmental changes and/or changes in the engine state, it has been determined that the actual engine oil temperature should be monitored and maintained at or near its optimum temperature. The optimum engine oil temperature will typically be higher in colder ambient air temperatures to counter the increased cooling effect of the air on the engine components.

The illustrated curves are optimum engine temperature curves. These curves are preferably utilized in conjunction with temperature control curves for controlling the temperature of the engine.

For the sake of simplicity, the engine temperature curves will be described as being a function of engine oil temperature and ambient air temperature. However, it should be understood that various alternate engine parameters and/or ambient conditions which may be utilized within the scope of the present invention. If alternate engine parameters are utilized, they are preferably indicative of the temperature of the engine oil. It is also contemplated that a fixed optimum engine oil temperature value may be utilized in the temperature control system (i.e., not a function of ambient air temperature). However, utilizing a fixed engine oil temperature value will not necessarily optimally control the temperature control system so as to minimize engine exhaust emissions.

In the illustrated embodiment curve A is utilized for determining the state of the engine (e.g., load condition, temperature state, etc.) This curve is utilized in conjunction with either a temperature control curve or a set of predetermined temperature values for controlling the actuation of the EETC valve. The specifics of this curve and how it is utilized for controlling flow of temperature control fluid is discussed in detail in related U.S. application Ser. No. 08/390,711 (which has been incorporated by reference) and U.S. application Ser. No. 08/469,957, filed Jun. 6, 1995 and entitled "SYSTEM FOR DETERMINING THE LOAD CONDITION OF AN ENGINE FOR MAINTAINING ENGINE OIL AT AN OPTIMUM TEMPERATURE," which is incorporated herein by reference. The curve is defined by a set of predetermined values preferably having an ambient air temperature component and an engine oil temperature component. In the preferred embodiment, the engine oil temperature component varies with the ambient air temperature component as follows:

$$T_{ENGINE\ OIL\ TEMPERATURE}=f\ T_{AMBIENT\ AIR\ TEMPERATURE}$$

where $T_{ENGINE\ OIL\ TEMPERATURE}$ is the temperature of the engine oil measured at a predetermined location, and $T_{AMBIENT\ AIR\ TEMPERATURE}$ is the temperature of the ambient air measured at a predetermined location. The locations where both temperatures are measured will determine the resulting curve. For example, measuring the temperature of ambient air temperature entering the radiator as compared with ambient air under the engine hood will produce two different control curves.

In a preferred embodiment, the temperature for the engine oil is measured in the oil pan and the temperature for the ambient air is measured either outside the engine compartment or in an air cleaner mounted on the engine. However, those skilled in the art would readily be capable of producing control curves for use in the instant invention based on ambient air temperatures and engine oil temperatures as measured at any location related to the engine.

While curve A has been discussed as varying with ambient air temperature and illustrated as a non-linear curve, it is also contemplated that curve A may be a step function or series of step functions which define the relationship between ambient air temperature and engine oil temperature. These alternate embodiments are all well within the purview of the claims.

As stated above, the engine oil temperature curve is utilized in conjunction with a temperature control curve for determining the appropriate state of the EETC valve. Specifically, the comparison of the actual engine oil temperature to the optimum engine oil temperature (for a given ambient air temperature) determines an adjustment factor for adjusting the temperature control curve. While it is also contemplated that the engine oil temperature curve can be utilized for directly actuating the EETC valve, it is not preferred since there is a significant time lag between the actuation of the EETC valve and the resulting actual engine oil temperature.

FIG. 6 also illustrates an exemplary embodiment of a second curve (curve B) which is also shown as a function of ambient air temperature and engine oil temperature. Curve B is shown positioned below Curve A and is utilized for controlling actuation of the control valves 40, 41 which control flow of temperature control fluid to and from the exhaust heat assembly 142. As with curve A, curve B can be embodied in various other configurations (e.g., can be a fixed value, can be a function of an ambient condition and an engine parameter, etc.). In the embodiment illustrated, the curve is defined by a set of predetermined values preferably having an ambient air temperature component and an engine oil temperature component. In the preferred embodiment, the engine oil temperature component varies with the ambient air temperature component as follows:

$$T'_{ENGINE\ OIL\ TEMPERATURE}=f\ T_{AMBIENT\ AIR\ TEMPERATURE}$$

where $T'_{ENGINE\ OIL\ TEMPERATURE}$ is the temperature of the engine oil measured at a predetermined location, and $T'_{AMBIENT\ AIR\ TEMPERATURE}$ is the temperature of the ambient air measured at a predetermined location. The locations where both temperatures are measured will determine the resulting curve.

Figure 7A:
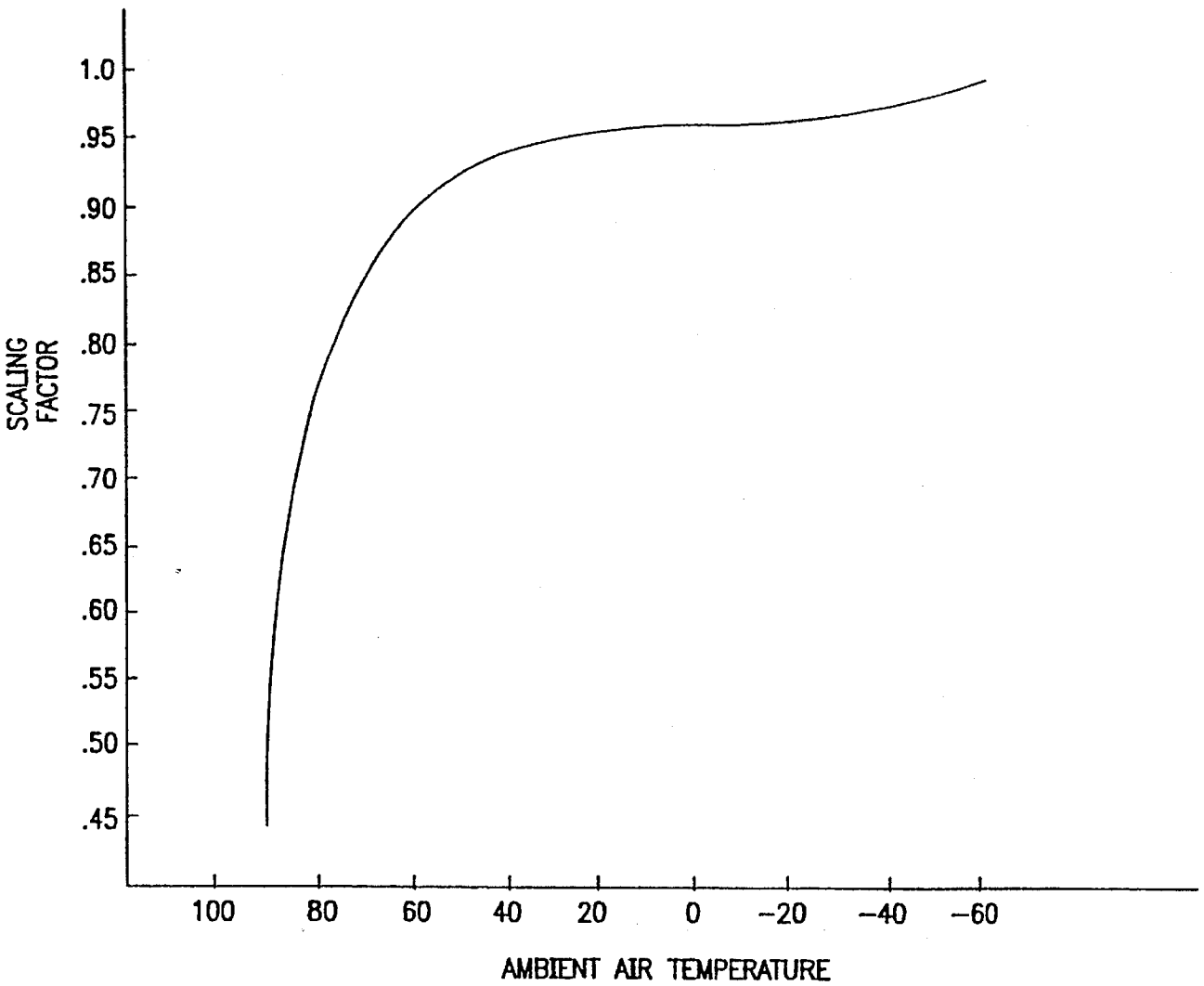
FIGS. 7A and 7B illustrate two alternate curves for producing a scaled temperature threshold value according to the present invention.
Figure 7B:
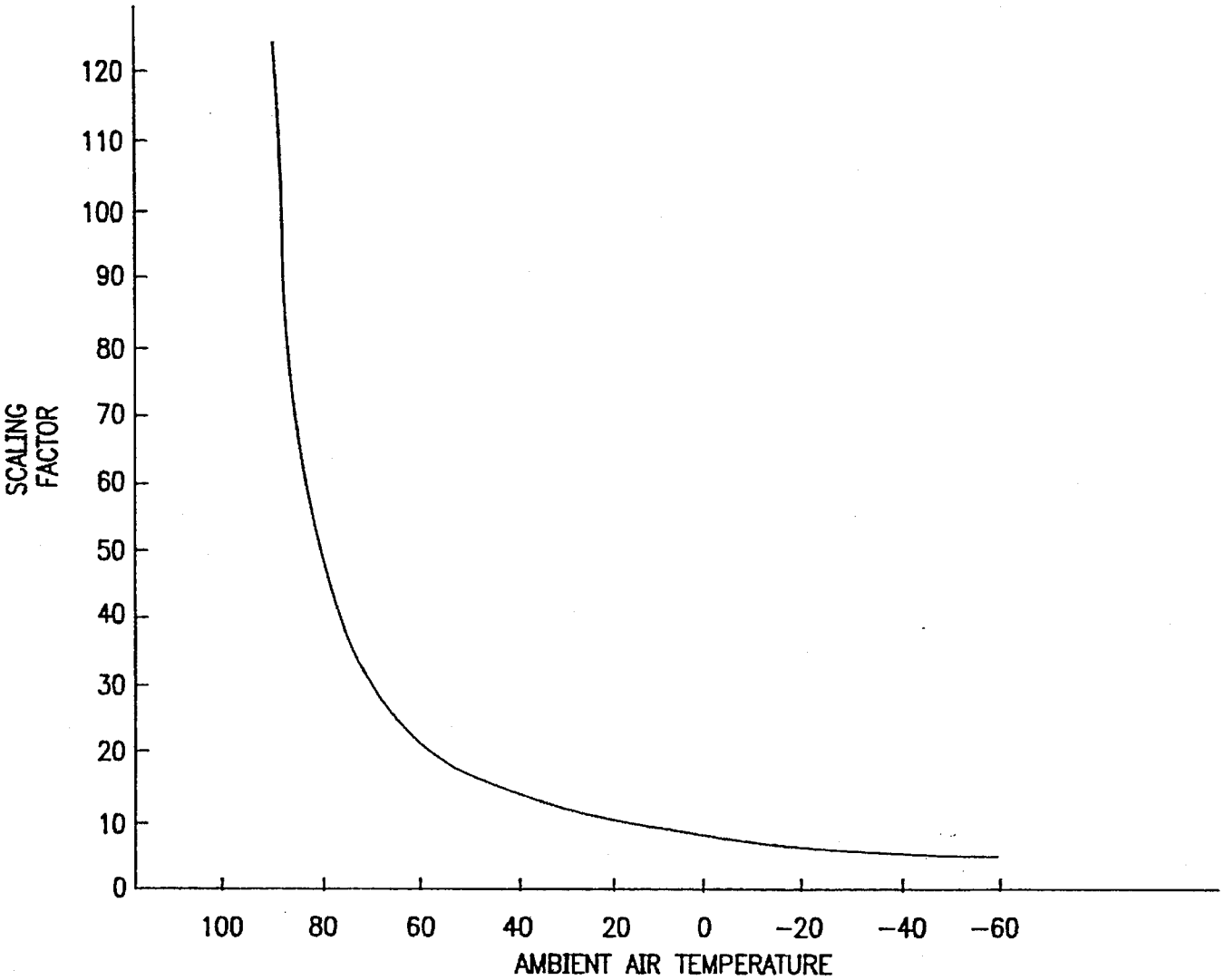

It is also contemplated that only one control curve is utilized and that a second temperature threshold value be determined by scaling the control curve. Referring to FIGS. 6, 7A and 7B, a first threshold temperature value is determined by comparing a sensed ambient air temperature to curve A. This threshold value is then utilized for controlling one or more values, such as the EETC valve. A second threshold value for controlling additional valves is determined by scaling the first threshold value. A scaling factor is determined by comparing the sensed ambient air temperature to a second curve. The scaling factor is then utilized with the first threshold temperature value for determining the second threshold temperature value.

For example, if the curve in FIG. 7A is utilized, the scaling factor and the first threshold temperature value are multiplied for determining the second threshold temperature value. If the curve in FIG. 7B is utilized, the scaling factor is subtracted from the first threshold temperature value to determine the second threshold temperature value. Alternate methods for determining the threshold temperature values should be readily apparent to those skilled in the art and are well within the purview of the claims.

The combination of curve A and curve B define three regions or zones designated I, II, and III, each zone relating to a state or position of the various valves. A clear understanding of the invention will be achieved when the curves are described in combination with the operation of the overall temperature control system, the hydraulic solenoid injection system 44 and the ECU 900.

The ECU 900 receives signals from one or more sensors which are indicative of an ambient air temperature and an engine oil temperature. The ECU 900 compares these signals or sensed temperatures to the curves shown in FIG. 6. (Alternately, the ECU 900 compares the signals to sets of predetermined values or to fixed values preferably having an ambient air temperature component and an engine oil temperature component.) If the combination of the measured ambient air temperature and engine oil temperature falls within Zone I, the engine is in a relatively cold state and the engine oil is well below its optimum operating temperature. It is therefore desirable to heat-up the engine oil as quickly as possible. This state typically occurs when the engine is initially started or if the vehicle is in a relatively cold environment.

In order to heat-up the engine oil toward its optimum operating temperature as quickly as possible, the temperature control system controls the flow of the temperature control fluid so as to harness the heat generated by the exhaust manifold 140 and transfer it to the engine oil. To achieve this, the ECU 900 sends signals to the hydraulic solenoid injection system 44 (FIG. 4) to open the input fluid injector 46 (and close the output fluid injector 48 if it is open). The pressurized hydraulic fluid then fills chamber 66. When the pressure of the fluid within the chamber 66 reaches a minimum of about 20 psi (as determined by a pressure sensor), the ECU 900 sends a signal to the third solenoid 74 to actuate it so as to permit pressurized fluid flow along supply line $76_A$. This causes the control valve 40 controlling flow from the water pump to the exhaust heat assembly 142 to actuate from its first position (inhibiting flow of temperature control fluid to the exhaust heat assembly 142) to its second position (permitting flow of temperature control fluid to the exhaust heat assembly 142).

At this point, the control valve 41 located downstream of the heating conduit 144 is in its first position wherein flow of temperature control fluid is inhibited from flowing out of the exhaust heat assembly 142 and back to the engine. Also at this point, the EETC valve 130 is in an unactuated position (since the sensed engine oil temperature and ambient air temperatures are below Curve A). Flow of temperature control fluid to the radiator is, thus, inhibited and cooling of the temperature control fluid by the radiator is prevented. A corollary of preventing flow of temperature control fluid into the radiator is that the significant quantity of fluid in the radiator is not directed into the engine water jacket. Hence, a reduced mass of temperature control fluid circulates through the system. The smaller mass of circulating temperature control fluid will, as a consequence, heat up significantly faster.

In this mode of operation of the temperature control system, a flow of temperature fluid is channeled into the heating conduit 144 of the exhaust heat assembly 142 adjacent to the exhaust manifold 140. The heat from the exhaust manifold 14 is conducted to temperature control fluid thereby raising its temperature.

A temperature sensor mounted on or in the heating conduit 144 measures the temperature of the temperature control fluid in the heating conduit 144 and sends a signal to the ECU 900. When the temperature of the temperature control fluid within the heating conduit 144 reaches a predetermined threshold value, the ECU 900 sends a signal to the third solenoid 74 to provide a flow of pressurized fluid along supply line $76_B$ which leads to the control valve 41 located downstream from the heating conduit 144. This pressurized fluid causes the control valve 41 to actuate into its second position wherein a flow of temperature control fluid is permitted along an exhaust return tube 152 and to the air induction system 150 or the oil pan 28.

In an alternate arrangement, the ECU 900 opens both control valves 40, 41 so as to permit an immediate flow of temperature control fluid to the oil pan or induction air system. This, however, is not the preferred method since the initial flow of temperature control fluid will not be sufficiently heated to provide any additional heating of the engine oil. On the contrary, the initial flow of temperature control fluid may be colder than the component (e.g., oil pan) to which it is sent. As a result, the component will initially decrease in temperature. It is more preferable, therefore, to prevent the temperature control fluid from flowing to the desired component until it has been sufficiently heated.

It may also be desirable to vary the amount of opening of the control valves 40, 41 so as to control the rate of flow of temperature control fluid through the exhaust heat assembly 142. That is, the amount of opening of the valves can be related to the temperature of the temperature control fluid. This will minimize any problems that may develop from sudden drastic temperature changes.

The ECU 900 continues to monitor the engine oil temperature and ambient air temperature and compares the measured signals against the curves in FIG. 6 or against predetermined values which define the curves. When the ECU 900 receives an engine oil temperature signal which, when combined with the ambient air signal, falls within Zone II, the engine oil is warm enough such that additional heating is not required. The ECU 900 sends signals to the hydraulic solenoid injection system 44 to change the valve positions accordingly.

Specifically, the ECU 900 sends signals to actuate control valve 40 leading to the exhaust heat assembly 142 into its first position wherein flow to the exhaust heat assembly 142 is prevented. This is accomplished by sending signals to close the input injector 46 (if it has not been previously closed) and open the output injector 48. This produces depressurization of the chamber 66. The ECU also sends a signal to the third solenoid 74 to open supply line $76_A$ (if it is not already open) permitting the pressurized fluid in the control valve 40 to drain into chamber 66 and out through outlet connector 72 to the reservoir.

It is preferable that the control valve 41 positioned downstream from the exhaust heat assembly 142 is simultaneously closed with control valve 40. This is achieved by sending a signal to the third solenoid 74 to open supply line $76_B$ (if it is not already open) thereby permitting the pressurized fluid in the control valve 41 to drain into chamber 66 and out of the hydraulic solenoid injector assembly 44.

The ECU 900 continues to monitor the engine oil temperature and ambient air temperature. If the ECU 900 receives an engine oil temperature signal which, when combined with the ambient air signal, falls within Zone III, the temperature of the engine oil is above its optimum value. At this point it is desirable to circulate at least a portion of the temperature control fluid through the radiator 12.

In order to accomplish this, the ECU 900 adjusts or shifts a temperature control curve which governs actuation of the EETC valve. (Alternately, the ECU adjusts or shifts one or more desired temperature control fluid temperature values.) This results is signals being sent to actuate the EETC valve 130 into is second position wherein the temperature control fluid is permitted to flow toward the radiator. (If the temperature control system instead has an EETC valve 130' as shown in phantom, then the valve is opened to allow a flow of fluid from the radiator and to the engine.) The signals cause the input injector 46 to open and the output injector 48 to close. This results in a supply of pressurized fluid entering chamber 66. The ECU also sends a signal to the third solenoid 74 to open supply line $76_C$ permitting the pressurized fluid to flow to the EETC valve 130 and fill its chamber 132 (FIG. 5). This produces displacement of valve member 136, thereby permitting temperature control fluid to flow along channel 138 and to the radiator 12.

If the ECU 900 subsequently determines that the combined temperature of the engine oil and ambient air has dropped from Zone III back to Zone II, the ECU depressurizes supply line $76_C$ by sending signals to close the input injector 46, open the output injector 48 and open supply line $76_C$. Thus, the pressurized fluid in the EETC valve 130 is allowed to drain into chamber 66 and out through outlet connector 72 to the reservoir.

It should be noted that, in the preferred temperature control system, the EETC valve is never in its open position (permitting flow to the radiator for cooling) when the exhaust heat assembly 142 is being utilized.

In each of the above sequences of operation, the ECU 900 closes the input injector 46 after actuating the valves into their desired positions. This traps pressurized fluid within chamber 66 and any open supply line 76. A pressure sensor (not shown) monitors pressure within the chamber 66. If the pressure within the chamber 66 falls below a threshold value (indicative of a fluid leak), the ECU 900 opens the input injector 46 to supply additional pressurized fluid to chamber 66. Alternately, the ECU can close the supply line 76 which has been pressurized, thereby locking the associated valve in its desired position.

It may be necessary to dither the injectors 46, 48 (i.e., controlled opening and closing of the injectors) to assist in draining the hydraulic solenoid injector assembly 44. Co-pending application Ser. No. 08/447,471, filed May 23, 1995, and entitled, "SYSTEM FOR DITHERING SOLENOIDS OF HYDRAULICALLY OPERATED VALVES AFTER ENGINE IGNITION SHUT-OFF" (incorporated herein by reference) discusses in detail several methods for dithering hydraulic solenoid injectors to assist in emptying a hydraulic fluid supply line. These methods can readily be applied to emptying the fluid supply lines after they have been depressurized. Preferably, the ECU 900 dithers the input and output injectors 46, 48 and the supply lines 76 when the engine has been shut-off.

Figure 10:
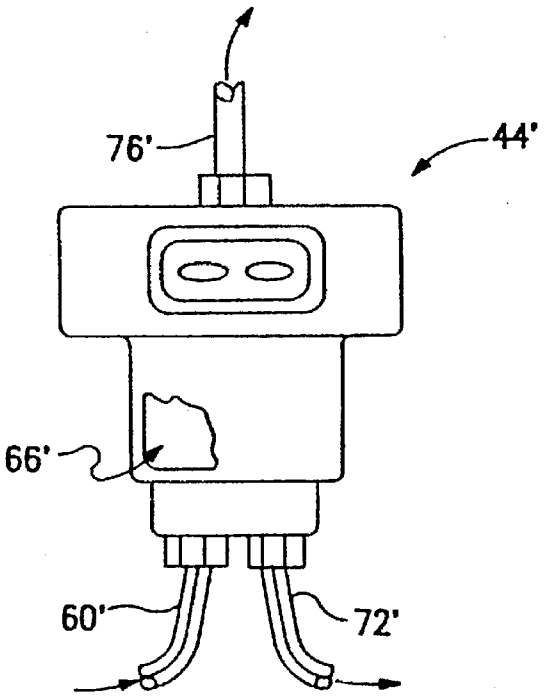
FIG. 10 is an alternate configuration of a solenoid pressurization system for controlling only one flow control valve.

While the ECU 900 has been described as sending signals to actuate solenoids and injectors, it is also contemplated that the signals from the ECU 900 can, instead, control linear actuators and/or other electro-mechanical flow control mechanisms. Those skilled in the art, after having read the instant specification, would readily be capable of modifying the configurations shown without detracting from the operability of the invention. FIG. 10 illustrates one alternate configuration of a solenoid valve 44' in a pressurization system for controlling one flow control valve, such as an EETC valve. The solenoid valve 44' includes an input line 60 and an output line 72. The input and output lines feed an internal chamber 66' which is in communication with a supply line 76'. Electrical signals from an engine commuter are sent by the solenoid valve 44' to control flow of hydraulic fluid from the chamber 66' to the supply line 76'.

Referring back to FIG. 1, the illustrated embodiment provides a novel arrangement of hydraulic lines which minimize the number of connections which may be subject to leakage. By mounting the hydraulic solenoid injector assembly 44 at a remote location and utilizing the multi-way solenoid 74, it is possible to route a single hydraulic line to each valve for controlling actuation of the valve. The utilization of a single injection system also reduces the overall cost and complexity of the temperature control system.

As discussed above, when the ECU determines that the combination of the engine oil temperature and ambient air temperature falls within Zone II of the curve in FIG. 6, it sends signals to actuate the control valves 40, 41 into their first positions. This will trap some temperature control fluid within heating conduit 144. As the trapped temperature control fluid heats up, it will begin to convert to high pressure steam. If this steam is not vented, it may eventually cause damage to the temperature control system and may result in the degradation of the fluid itself. In order to evacuate the steam from the heating conduit 144, a pressure escape port 200 (FIGS. 2A and 2B) is preferably incorporated into at least one of control valves 40, 41. The pressure escape port 200 is an aperture formed in the second housing of the control valve and is in fluid communication with the heating conduit 144. The pressure escape port may be formed integral with or separately attached to the housing.

Referring to FIGS. 1 and 5, the pressure escape port 200 is connected through a tube 202 to a pressure relief valve 204 which is in communication with a portion of the housing 206 of the EETC valve 130. The pressure escape port 200, tube 202 and pressure relief valve 204 provide a means for channeling or venting the pressurized steam out of the heating conduit 144.

A preferred embodiment of the pressure relief valve 204 includes an insert 208 which retains a ball 210 within a compartment 212. The insert 208 has a passage 209 formed through it which is in communication with the tube 202. A spring 214 biases the ball away from a wall 215 of the compartment 212 and toward the insert 208. A pressure relief orifice 216 is formed through the wall 215 and permits fluid communication between the compartment 212 and the channel 138 of the EETC valve 130. In the illustrated embodiment, the insert 208 and the tube 202 are both threadingly engaged with the housing 206. Alternate attachment mechanisms are possible.

The sizing and configuration of the tube 202 and pressure relief valve 204 is preferably determined so as to prevent the liquid in the heating conduit 144 from becoming too hot after it has turned to steam. The temperature of the exhaust manifold 140 can reach upwards of 1500 degrees Fahrenheit. If the trapped temperature control fluid is exposed to this excessive temperature for a prolonged period of time, the temperature control fluid may begin to break down (i.e., the mixture of the water and glycol may begin to separate). Accordingly, the tube 202 and the pressure relief valve 204 are preferably designed to quickly vent the exhaust heat assembly 142 so as to result in dry tubes. It is also desirable, when designing the tube 202 and the pressure relief valve 204, to minimize the noise associated by the steam passing through the pressure relief valve 204 and into the radiator. In one preferred embodiment, the tube 202 has a diameter of approximately 0.25 inches. The diameter of the insert passage is approximately 0.375 inches. The pressure relief orifice has a diameter that is preferably between about 0.150 inches to about 0.180 inches.

When the ball 210 is in the position shown, fluid communication between the EETC valve 130 and the tube 202 is prevented. This position typically occurs when there is a relatively low amount of pressure in the exhaust heating assembly 142. As pressure builds up in the exhaust heating assembly 142, the pressure on the tube side of the ball 210 increases and eventually overcomes the spring force of the spring 214. As a result, the ball 210 is forced away from the insert 208 permitting fluid communication between the tube 202 and the EETC valve 130. In one preferred embodiment, the pressure needed to overcome the spring force is approximately 15 psi. FIGS. 3 and 3A illustrate the alternate mounting of the tube 202 to the control valve 41 located downstream from the exhaust heat assembly 142.

The novel pressure relief system described above permits pressure in the exhaust heat assembly 142 to be vented to the radiator before any damage to the temperature control system can occur. Alternate methods for venting the high pressure steam from the exhaust heat assembly 142 can be readily substituted for the above method and are well within the purview of the invention. For example, the steam can be vented into an fluid overflow bottle associated with the radiator. However, doing so may require the incorporation of baffles (not shown) into the bottle to reduce the noise of as the steam enters. Alternately, the steam can be channeled directly into the radiator. Venting to the radiator (either by means of the EETC valve or directly into the radiator) is preferred so as to quickly circulate and cool the heat temperature steam in the radiator. It is contemplated that a considerable amount of temperature control fluid in the radiator will be displaced by the steam since steam occupies a considerably larger volume than the condensed liquid. To accommodate this additional volume of fluid media, a larger fluid overflow bottle may be required.

The above described system will accurately and efficiently assist in maintaining the engine oil at or near its optimum temperature. It is, however, anticipated that as the temperature control system switches between channeling temperature control fluid to the exhaust heat assembly 142 and the engine block pockets of air may develop. This is likely to occur when the control valves 40, 41 are opened so as to permit temperature control fluid to flow into the exhaust heater assembly 142. Prior to opening, the exhaust heat assembly 142 would contain a sizable amount of trapped air. Upon opening of the valves 40, 41, the flow of temperature control fluid will force the air in the heating conduit 144 to flow through the temperature control system.

Trapped air within the system tends to reduce the cooling and heating capabilities of the system and, thus, reduce its overall efficiency.

Air pockets may also develop within the water pump 16 during operation of the temperature control system. Variations in suction and pressurization within the water pump 16 during the different phases of operation of the temperature control system could lead to the formation of small air pockets within the system. These air pockets, similar to the air pockets generated in the exhaust heat assembly 142, may eventually travel through the system resulting in reduced efficiency.

To remedy these problems the present system incorporates a free flow buoyancy check valve 800 which is attached to the radiator fluid overflow container 802, commonly known as an overflow bottle. Referring to FIG. 3, a schematic is shown of a portion of the fluid overflow bottle 802 illustrating the attachment of the free flow buoyancy check valve 800 to the fluid overflow bottle 802 and to the water pump 16. The free flow buoyancy check valve 800 provides a means for directly channeling a flow of temperature control fluid from the fluid overflow container 802 and into the water pump 16 when it is required. By channeling this additional source of fluid to the water pump 16, it is possible to reduce the amount of air pockets that develop within the water pump 16 when the it is not receiving a sufficient amount of temperature control fluid to accommodate the demand imposed by the temperature control system. The free flow buoyancy check valve 800 provides additional fluid to help reduce the demand.

Figure 9:
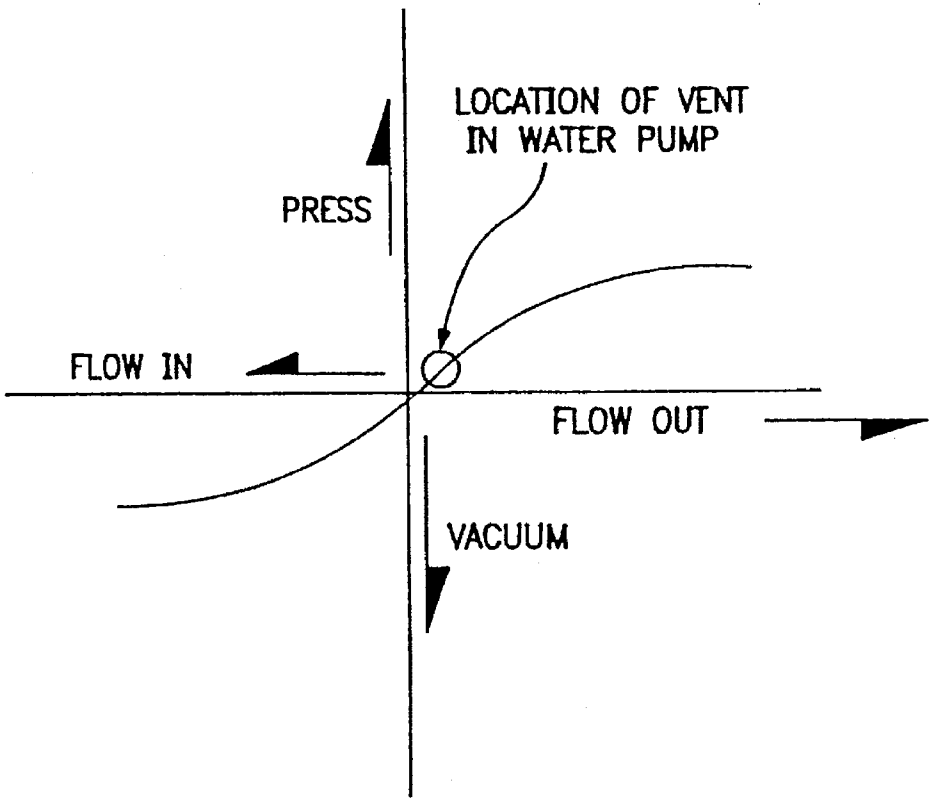
FIG. 9 is a graph of the pressure/vacuum pressures within the water pump illustrating a preferred location for a vent bleed line.

Also shown is an air bleed tube 804 attached between the water pump 16 and the fluid overflow container 802. The air bleed tube 804 is designed to bleed or vent trapped air out of the water pump 16 and channel it to the fluid overflow container. As discussed above, air bubbles that develop in the system will reduce the efficiency of the overall temperature control system. By attaching a vent line to the water pump 16, it is possible to vent out these air pockets as they circulate. Referring to FIG. 9, a graph of pressure/vacuum in the water pump is illustrated. The vent line is preferably affixed to the water pump 16 so as to be in communication with the interior cavity approximately at the transition between the suction and pressure pressures. This ensures that air will be vented air of the water pump along the vent line as opposed to being drawn in. The air bleed tube 804 is attached to the fluid overflow container 802 at an upper location where it will vent the air from the water pump 16 to the fluid overflow container 802. Preferably the attachment is above the water line in the fluid overflow container 802, otherwise bubbling in the container will occur. The vent line can be made from any suitable material and preferably has a diameter between approximately 0.060 inches and 0.080 inches.

Figure 8B:
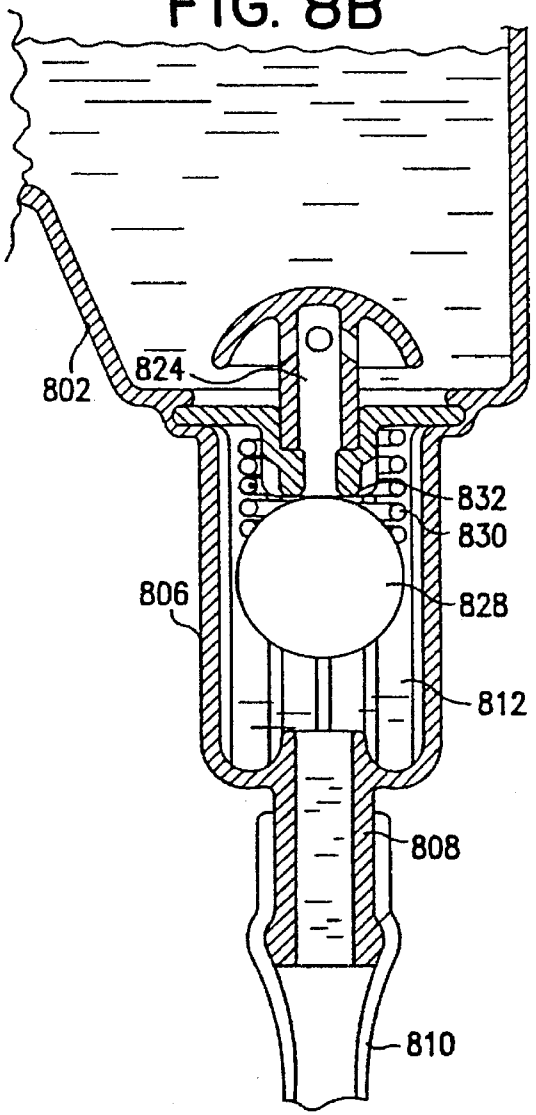
FIGS. 8A through 8D illustrate various stages of a free flow buoyancy check valve according to the present invention.
Figure 8A:
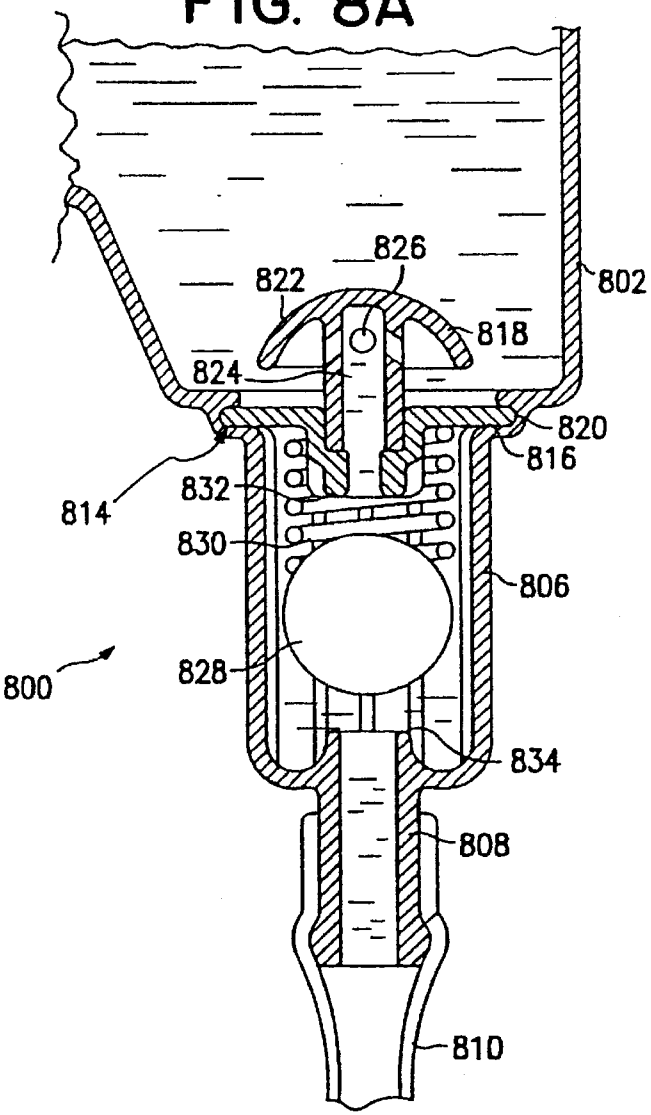

Referring to FIG. 8A, a preferred configuration of the free flow buoyancy check valve 800 is shown in more detail. The valve 800 is mounted directly to the bottom of the fluid overflow container 802. The valve 800 includes a housing 806 with a check valve outlet 808 formed thereon. The check valve outlet 808 is connected via an overflow outlet tube 810 to the water pump 16. The overflow outlet tube 810 functions as a conduit for channeling fluid between the check valve outlet 808 and the interior of the water pump 16. In a preferred embodiment, the overflow outlet tube attaches to the inlet tube leading into the water pump 16.

The housing 806 also includes a chamber 812 for channeling fluid between the check valve outlet 808 and the fluid overflow container 802. A cap assembly 814 is mounted to an end of the housing 806 and controls flow of temperature control fluid between the chamber 812 and the fluid overflow container 802. In one embodiment, the cap assembly 814 includes split ring portions 816 and a diffuser cap 818. The split ring portions 816 engage with a locking seat 820 formed in the housing 806. When installed within the locking seat 820, the ring portions 816 lock the diffuser cap 818 to the housing 806. The diffuser cap 818 preferably has a semi-circular dome 822 which extends into the fluid overflow container 802 when the diffuser cap 818 is attached to the housing 806. The diffuser cap 818 also has a channel 824 formed in it which is adapted to conduct fluid from the chamber 812 through a plurality of holes 826 formed in the diffuser cap 818 and into the fluid overflow container 802.

The present invention also incorporates in the valve housing a control means for controlling flow through the valve. In one embodiment, the control means comprises a ball 828 which is movably disposed within the chamber 812 between the check valve outlet 808 and the cap assembly 814. The ball 828 is configured to seat on an upper ball seat 832 surrounding the channel 824 and on a lower ball seat 834 surrounding the check valve outlet 808. When the ball seats against the upper ball seat 832, flow of temperature control fluid is prevented from passing through the channel 824. Similarly, when the ball seats against the lower ball seat 834, flow of temperature control fluid is prevented from passing through the check valve outlet 808.

A spring 830 is located between the ball 828 and the cap assembly 814. The spring 830 biases the ball 828 away from the cap assembly 814 so as to prevent the ball 828 from seating on the upper ball seat 832 surrounding the channel 824. Preferably the spring 830 does not bias the ball 828 into seating on the lower ball seat 834. The spring is preferably made from stainless steel, although other materials can be readily substituted therefor.

FIGS. 8A through 8D illustrate various stages of operation of the free flow buoyancy check valve 800. In FIG. 8A, the valve 800 is shown in a first stage wherein the water pump 16 is not receiving a sufficient flow of temperature control fluid. This shortage of fluid in the water pump 16 creates a draw or suction along overflow outlet tube 810 resulting in temperature control fluid flowing from the fluid overflow container 802, through the chamber 812 and out the check valve outlet 808. This flow of temperature control fluid is channeled directly into the water pump 16 for mixing with the fluid already contained therein.

FIG. 8B illustrates a second stage wherein the water pump 16 is receiving a sufficient amount of temperature control fluid and, therefore, additional fluid is not needed. That is, the fluid pressure within the water pump creates a back pressure flow of temperature control fluid along the overflow outlet tube 810 and into the valve 800 from the water pump 16. This flow of temperature control fluid creates pressure within the chamber which forces the ball 828 to compress the spring 830 until the ball 828 seats against the upper ball seat 832. The seating of the ball 828 against the upper ball seat 832 prevents flow of temperature control fluid into the fluid overflow container 802.

Figure 8D:
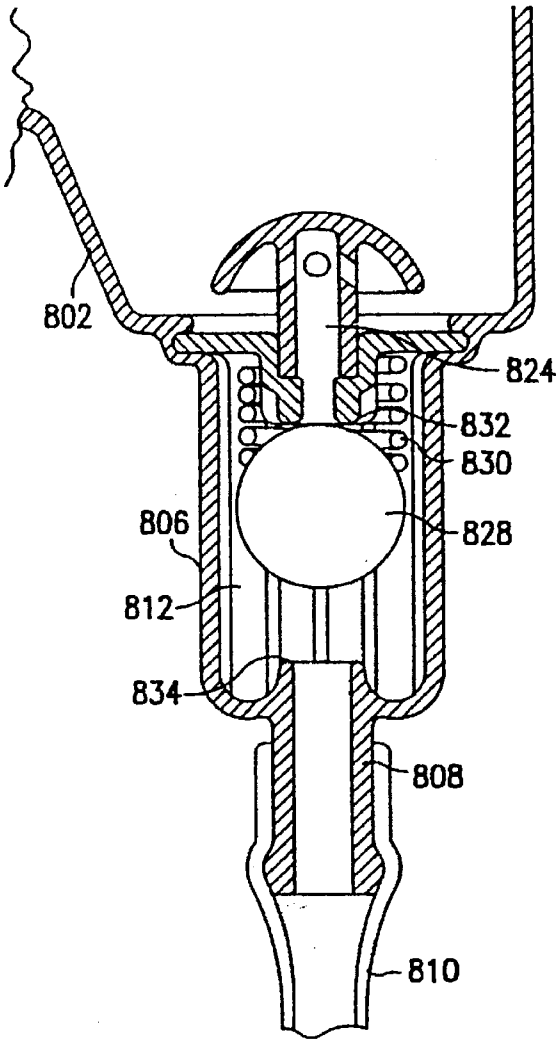
Figure 8C:
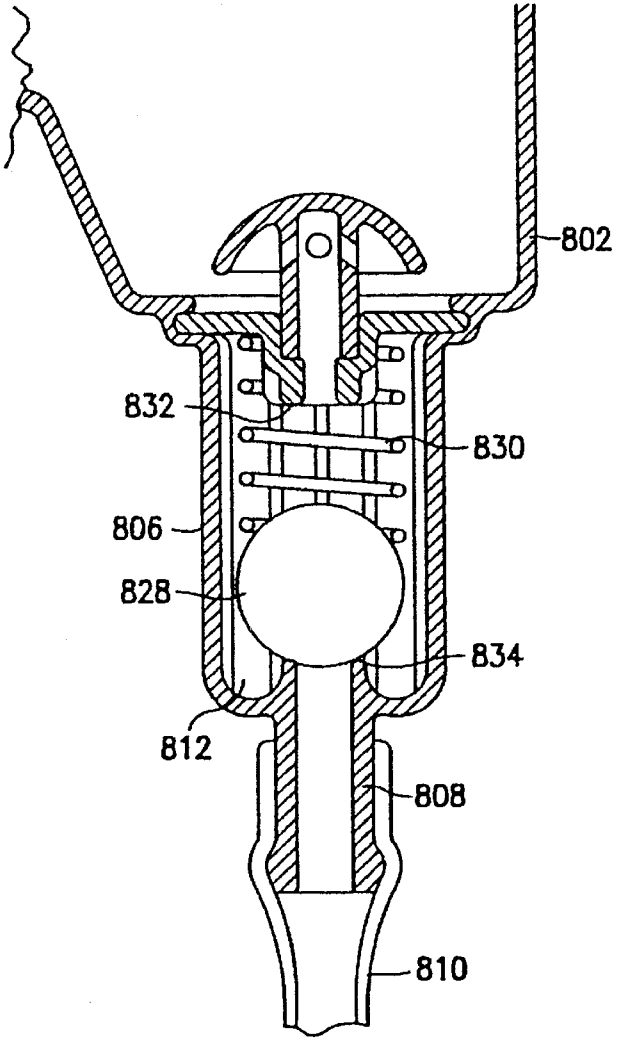

FIGS. 8C and 8D illustrate third and fourth stages of the valve 800 wherein the fluid overflow container has a very low level of temperature control fluid contained within it. In FIG. 8C, the water pump 16 is not receiving a sufficient flow of temperature control fluid. This creates a draw or suction along overflow outlet tube 810. Since the fluid overflow container 802 does not have sufficient fluid to accommodate the draw from the water pump 16, air will be drawn into the water pump 16 unless the valve 800 is closed. As shown, the ball 828 is designed to seat against the lower ball seat 834 when the fluid in the fluid overflow container 802 is low so as to seal or close the valve 800. This prevents air in the fluid overflow container from being drawn into the overflow outlet tube 810.

FIG. 8D, illustrates the fourth stage wherein the water pump 16 is receiving a sufficient flow of temperature control fluid. As a result, a flow of temperature control fluid flows from the water pump 16 to the valve 800 along overflow outlet tube 810. Since there is no fluid within the fluid overflow container to counter the flow of temperature control fluid, the fluid flow easily forces the ball 828 to seat against the upper ball seat 834 sealing the channel 824. Flow of temperature control fluid into the fluid overflow container 802 is, thus, prevented.

In one preferred embodiment, the channel 824 is approximately ¼" diameter and the check valve outlet 808 has an internal diameter of approximately 5/16" diameter. The channel and outlet 808 should be sized so as to only require a small amount of back pressure to seat the ball 828 on the upper seat. The housing 806 is shown as being formed integral with the fluid overflow container. However, it is contemplated that the housing 806 can be a separate component which is mounted to the fluid overflow container 802 and can be made from any suitable material. The ball 828 is preferably made from plastic material so as to permit it to float within the chamber 812. Again other materials may be substituting without detracting from the invention.

In an alternate embodiment of the invention, the ball 828 is made from hollow stainless steel or aluminum and the lower ball seat 834 has two electrical contacts formed thereon which do not contact one another. In this embodiment, when the ball 828 is seated within the lower ball seat 834 (i.e., low fluid level in the fluid overflow container), the metallic material of the ball 828 provides electrical continuity between two contacts. This electrical continuity can be utilized to trigger a light displayed on a dashboard for indicating a low fluid level in the fluid overflow container 802.

The novel overflow free flow buoyancy check valve 800 configuration described above provides a flow of temperature control fluid between the water pump 16 and the fluid overflow container 802 when additional fluid is needed. The valve 800 also prevents air from being drawn into the water pump 16 from the fluid overflow container 802 when the temperature control fluid within the container 802 is low. The ball 828 also prevents the fluid from leaving the temperature control fluid circuit in the engine whether or not there is temperature control fluid in the container. In order to provide a sufficient amount of pressure for the system, it is contemplated that the fluid overflow container 802 should be designed so as to produce approximately 1 foot of temperature control fluid pressure head. This pressure head should provide sufficient pressure to allow the system to operate efficiently.

The free flow buoyancy check valve 800 can be configured in other ways for controlling flow of temperature control fluid (e.g., hydraulic valve, solenoid valve, etc.) Additionally, while the preferred system channels temperature control fluid from the fluid overflow container to the water pump, other sources (e.g., radiator) and destinations (e.g., water pump inlet tube) for the fluid flow may be utilized and are well within the scope of the invention.

The above described temperature control system has particular utilization in the diesel engine industry. Diesel engines typically operate at a significantly lower temperature than standard automobile internal combustion engines. The lower temperatures of these engines results in increased oil sludge build-up. To diminish the development of sludge, the engine oil must frequently be changed. Truck diesel engines typically utilize 10 to 16 quarts of engine oil and, therefore, frequent engine oil changes can become quite expensive. The present invention significantly improves the condition of the engine oil by maintaining its temperature at or near an optimum temperature. As a result, the time between engine oil changes can be extended, thus reducing the cost of operating the diesel engine.

While the preferred embodiments utilize hydraulic fluid for controlling the state or position of the flow restrictor valves and EETC valve, other fluid media may be utilized, such as water, temperature control fluid, air, etc.

Accordingly, although the invention has been described and illustrated with respect to the exemplary embodiments thereof, it should be understood by those skilled in the art that the foregoing and various other changes, omissions and additions may be made therein and thereto, without parting from the spirit and scope of the present invention.

I claim:

1. A solenoid injection system for controlling actuation of flow control valves in a temperature control system, the solenoid injection system comprising:

a housing having a chamber formed therein;

an inlet line connected to the housing and adapted to supply a flow of fluid into the housing;

an outlet line connected to the housing and adapted to channel a flow of fluid out of the housing;

an input injector connected to the housing and in communication with the chamber and the inlet line, the input injector having an open position adapted for channeling a flow of pressurized fluid from the inlet line into the chamber and a closed position adapted for preventing a flow of pressurized fluid from the inlet line into the chamber;

a first solenoid connected to the input injector operative for actuating the input injector between its open and closed positions, the first solenoid adapted to receive a signal from an engine computer for controlling actuation of the input injector;

an output injector connected to the housing and in communication with the chamber and the outlet line, the output injector having an open position adapted for channeling a flow of fluid out of the chamber and into the outlet line and a closed position adapted for preventing a flow of fluid out of the chamber and into the outlet line;

a second solenoid connected to the output injector operative for actuating the output injector between its open and closed positions, the second solenoid adapted to receive a signal from an engine computer for controlling actuation of the output injector; and a third solenoid connected to the housing and in fluid communication with the chamber, the third solenoid having at least one fluid supply line connected thereto, the supply line adapted to channel a flow of pressurized fluid to a flow control valve for controlling actuation of the valve, the third solenoid having an open position for permitting flow of pressurized fluid along the supply line and a closed position for inhibiting fluid flow along the supply line, and wherein the third solenoid is adapted to receive signals from an engine computer for controlling flow of pressurized fluid along the supply line.

2. A solenoid injection system according to claim 1 wherein the input injector is located within an input compartment formed in the housing, the input compartment being in fluidic communication with the inlet line, the input injector being adapted to direct a flow of temperature control fluid from the input compartment into the chamber, and wherein the output injector is located within an output compartment formed in the housing, the output compartment being in fluidic communication with the outlet line, the output injector being adapted to direct a flow of temperature control fluid out of the chamber and into the output compartment.

3. A solenoid injection system according to claim 2 wherein the housing has a central plane and wherein the input and output compartments are located on either side of the central plane and are angled with respect to the central plane.

4. A solenoid injection system according to claim 1 wherein the fluid is hydraulic fluid and wherein the input and output injectors are adapted to channel a flow of hydraulic fluid between a fluid source and the chamber.

5. A solenoid injection system according to claim 1 wherein the supply line is adapted to direct a flow of pressurized fluid to an electronic engine temperature control valve which controls flow of temperature control fluid between an engine and a radiator, the flow of pressurized fluid being adapted to produce actuation of the valve.

6. A solenoid injection system according to claim 5 wherein a second supply line is adapted to direct a flow of pressurized fluid to a flow control valve for controlling flow of temperature control fluid through an exhaust heat assembly mounted adjacent to an exhaust manifold.

7. A solenoid injection system for controlling actuation of flow control valves in a temperature control system, the solenoid injection system comprising:

a housing having a chamber formed therein;

input means in communication with the housing for channeling a flow of fluid into the chamber;

output means in communication with the housing for channeling a flow of fluid out of the chamber; and a solenoid connected to the housing and positioned within the chamber, the solenoid having at least one fluid outlet adapted to direct a flow of pressurized fluid to a flow control valve for controlling actuation of the valve, the solenoid having an open position for allowing a flow of pressurized fluid out of the fluid outlet and a closed position for preventing fluid flow out of the fluid outlet, the solenoid being adapted to receive signals from an engine computer for controlling the solenoid between its open and closed positions.

8. A solenoid injection system according to claim 7 further comprising:

an inlet formed in the housing for directing a flow of fluid into the housing and to the input means; and an outlet formed in the housing for directing a flow of fluid out of the housing and to the output means.

9. A solenoid injection system according to claim 7 wherein the input means includes an injector for injecting a flow of fluid into the chamber; and wherein the output means includes an injector for injecting a flow of fluid out of the chamber.

10. A solenoid injection system according to claim 7 wherein the fluid outlet is adapted to direct a flow of pressurized fluid to an electronic engine temperature control valve which controls flow of temperature control fluid between an engine and a radiator, the flow of pressurized fluid being adapted to produce actuation of the valve.

11. A solenoid injection system according to claim 10 wherein the solenoid includes a second fluid outlet which is adapted to direct a flow of pressurized fluid to a flow control valve for controlling flow of temperature control fluid through an exhaust heat assembly mounted adjacent to an exhaust manifold.

12. A solenoid injection system according to claim 7 wherein the fluid is hydraulic fluid and wherein the input and output means are adapted to channel a flow of hydraulic fluid.

13. A pressurization system for controlling actuation of flow control valves in a temperature control system, the pressurization system comprising:

a housing having a chamber formed therein;

an input injector in communication with the housing for channeling a flow of pressurized fluid into the chamber;

an output injector in communication with the housing for channeling a flow of pressurized fluid out of the chamber; and fluid flow control means connected to the housing and having at least one fluid outlet adapted to direct a flow of pressurized fluid to a flow control valve to control actuation thereof, the fluid flow control means having an open position for allowing a flow of pressurized fluid out of the fluid outlet and a closed position for preventing fluid flow out of the fluid outlet, the fluid flow control means being adapted to receive signals from an engine computer for controlling actuation of the fluid flow control means between its open and closed positions.

14. A pressurization system according to claim 13 wherein the fluid flow control means is a flow control valve.

15. A pressurization system according to claim 14 wherein the flow control valve is a solenoid.

16. A pressurization system according to claim 13 wherein the pressurized fluid is hydraulic fluid and wherein the input and output injectors are adapted to channel a flow of hydraulic fluid.

17. A pressurization system according to claim 13 wherein the fluid outlet is adapted to direct a flow of pressurized fluid to an electronic engine temperature control valve which controls flow of temperature control fluid between an engine and a radiator, the flow of pressurized fluid being adapted to produce actuation of the valve.

18. A pressurization system according to claim 17 wherein the fluid flow control means includes a second fluid outlet which is adapted to direct a flow of pressurized fluid to a flow control valve for controlling flow of temperature control fluid through an exhaust heat assembly mounted adjacent to an exhaust manifold.

19. An injection system for controlling actuation of flow control valves in a temperature control system, the injection system comprising:

a housing having a chamber formed therein;

an inlet line connected to the housing and adapted to supply a flow of fluid into the housing;

an outlet line connected to the housing and adapted to channel a flow of fluid out of the housing;

an input injector connected to the housing and in communication with the chamber and the inlet line, the input injector having an open position adapted for channeling a flow of pressurized fluid from the inlet line into the chamber and a closed position adapted for preventing a flow of pressurized fluid from the inlet line into the chamber;

a first solenoid connected to the input injector operative for actuating the input injector between its open and closed positions, the first solenoid being adapted to receive a signal from an engine computer for controlling actuation of the input injector;

an output injector connected to the housing and in communication with the chamber and the outlet line, the output injector having an open position adapted for channeling a flow of fluid out of chamber and into the outlet line and a closed position adapted for preventing a flow of fluid out of the chamber and into the outlet line;

a second solenoid connected to the output injector operative for actuating the output injector between its open and closed positions, the second solenoid being adapted to receive a signal from an engine computer for controlling actuation of the output injector; and a third solenoid connected to the housing and in fluid communication with the chamber, the third solenoid having at least one supply line connected thereto, the supply line being adapted to channel a flow of pressurized fluid to a flow control valve for controlling actuation of the valve, the third solenoid having an open position for permitting flow of pressurized fluid along the supply line and a closed position for inhibiting fluid flow along the supply line, and wherein the third solenoid is adapted to receive signals from an engine computer for controlling flow of pressurized fluid along the supply line.

20. A pressurization system for controlling actuation of flow control valves in a temperature control system, the system comprising:

a housing having a chamber formed therein;

input line attached to the housing and adapted for channeling a flow of pressurized fluid into the chamber;

output line attached to the housing for channeling a flow of fluid out of the chamber; and a solenoid connected to the housing and positioned within the chamber, the solenoid having at least one fluid outlet adapted to direct a flow of pressurized fluid to at least one flow control valve for controlling actuation of the valve, the solenoid having an open position for allowing a flow of pressurized fluid out of the fluid outlet and a closed position for preventing fluid flow out of the fluid outlet, the solenoid being adapted to receive signals from an engine computer for controlling the solenoid between its open and closed positions, the signals being determined in accordance with a predetermined schedule which is a function of at least engine oil temperature.

21. A method for controlling actuation of flow control valves in a temperature control system with the use of an injection system, the injection system including at least one input injector and at least one output injector mounted within a housing, each injector having an open position for permitting fluid flow along a passageway and a closed position for preventing fluid flow along a passageway, the method comprising the steps of:

supplying a flow of fluid to the input injector from a fluid source;

placing the input injector into its open position;

placing the output injector into its closed position;

filling a chamber within the housing with the supplied fluid;

controlling a solenoid so as to open a supply line to at least one of the flow control valves for providing a supply of fluid from the housing to the valve, the supply of fluid operative for actuating the flow control valve; and closing the input injector after the flow control valve has been actuated so as to trap fluid within the chamber.

22. A method for controlling actuation of a flow control valve according to claim 21 wherein the step of controlling the solenoid involves the steps of opening a supply line to the flow control valve to actuate it into its open position, the open position of the flow control valve permitting a flow of temperature control fluid along a conduit, and closing the supply line to the flow control valve to actuate it into its closed position.

23. A method for controlling actuation of a flow control valve in a temperature control system with the use of a solenoid pressurization system, the solenoid pressurization system including at least one solenoid valve which is in fluidic communication with the flow control valve, the solenoid valve having an open position for permitting fluid flow along a supply line and a closed position for preventing fluid flow along a supply line, the method comprising the steps of:

supplying a flow of fluid to the solenoid valve from a pressurized fluid source;

receiving a signal from an engine computer directing a flow of pressurized fluid along the supply line;

controlling the solenoid so as to open a supply line to the flow control valve directing a flow of pressurized fluid along the supply line, the supply of fluid operative for actuating the flow control valve; and closing the solenoid after the flow control valve has been actuated.

24. A solenoid injection system according to claim 1 wherein there are a plurality of supply lines, one of the supply lines being adapted to direct a flow of pressurized fluid to an electronic engine temperature control valve which controls flow of temperature control fluid between an engine and a radiator, the flow of pressurized fluid being adapted to produce actuation of the valve, a second supply line being adapted to direct a flow of pressurized fluid to a second flow control valve positioned at one end of an exhaust heat assembly mounted adjacent to an exhaust manifold, the second flow control valve adapted to control flow of temperature control fluid into the exhaust heat assembly, and a third supply line being adapted to direct a flow of pressurized fluid to at least a third flow control valve positioned at another end of the exhaust heat assembly, the third flow control valve adapted to control flow of temperature control fluid out of the exhaust heat assembly.

25. A solenoid injection system according to claim 24 wherein the third supply line also directs flow of pressurized fluid to the second flow control valve.

* * * * *